US010691033B2

(12) United States Patent
Nishida et al.

(10) Patent No.: US 10,691,033 B2
(45) Date of Patent: Jun. 23, 2020

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Tsutomu Nishida, Mishima (JP); Atsushi Okuda, Yokohama (JP); Yuka Ishiduka, Suntou-gun (JP); Nobuhiro Nakamura, Numazu (JP); Hiroyuki Watanabe, Suntou-gun (JP); Hideharu Shimozawa, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/287,102

(22) Filed: Feb. 27, 2019

(65) Prior Publication Data

US 2019/0265601 A1 Aug. 29, 2019

(30) Foreign Application Priority Data

Feb. 28, 2018 (JP) ..... 2018-035736

(51) Int. Cl.
*G03G 5/147* (2006.01)
*G03G 5/05* (2006.01)
*G03G 5/07* (2006.01)

(52) U.S. Cl.
CPC ..... *G03G 5/0546* (2013.01); *G03G 5/0575* (2013.01); *G03G 5/0589* (2013.01); *G03G 5/0592* (2013.01); *G03G 5/0596* (2013.01); *G03G 5/071* (2013.01); *G03G 5/14734* (2013.01); *G03G 5/14791* (2013.01); *G03G 5/14795* (2013.01)

(58) Field of Classification Search
CPC ..... G03G 5/0546; G03G 5/0535; G03G 5/14721; G03G 5/14734; G03G 5/071; G03G 5/0592
See application file for complete search history.

(56) References Cited

U.S. PATENT DOCUMENTS 5,155,200 A * 10/1992 Limburg ..... C08G 18/329 528/67
5,374,494 A * 12/1994 Kashimura ..... G03G 5/0592 358/296
6,991,881 B2 1/2006 Yoshida et al.
6,994,941 B2 2/2006 Tanaka et al.
7,001,699 B2 2/2006 Tanaka et al.
7,645,547 B2 1/2010 Okuda et al.
7,655,370 B2 2/2010 Kitamura et al.
7,910,274 B2 3/2011 Tanaka et al.
8,088,541 B2 1/2012 Tanaka et al.
8,455,170 B2 6/2013 Nakamura et al.
8,481,236 B2 7/2013 Tanaka et al.
8,632,935 B2 1/2014 Sugiyama et al.
8,669,027 B2 3/2014 Anezaki et al.
8,753,789 B2 6/2014 Ogaki et al.
8,765,335 B2 7/2014 Tanaka et al.
8,815,479 B2 8/2014 Shida et al.
8,846,281 B2 9/2014 Okuda et al.
8,865,381 B2 10/2014 Tanaka et al.
8,921,020 B2 12/2014 Murai et al.
8,980,508 B2 3/2015 Okuda et al.
8,980,509 B2 3/2015 Noguchi et al.
9,029,054 B2 5/2015 Okuda et al.
9,040,214 B2 5/2015 Fujii et al.
9,046,797 B2 6/2015 Fujii et al.
9,063,505 B2 6/2015 Sekiya et al.
9,069,267 B2 6/2015 Kaku et al.
9,114,565 B2 8/2015 Kawai et al.
9,170,506 B2 10/2015 Tanaka et al.
9,170,507 B2 10/2015 Sugiyama et al.
9,188,888 B2 11/2015 Okuda et al.
9,207,550 B2 12/2015 Okuda et al.
9,256,145 B2 2/2016 Fujii et al.
9,280,071 B2 3/2016 Maruyama et al.
9,280,072 B2 3/2016 Ogaki et al.
9,282,615 B2 3/2016 Yamagishi et al.
9,304,416 B2 4/2016 Noguchi et al.
9,316,932 B2 * 4/2016 Nonaka ..... G03G 5/0618
9,341,964 B2 5/2016 Ogaki et al.
9,360,822 B2 6/2016 Black et al.
9,372,417 B2 6/2016 Fujii et al.
9,372,418 B2 6/2016 Shida et al.
9,372,419 B2 6/2016 Tsuji et al.
9,423,706 B2 * 8/2016 Nonaka ..... G03G 5/047
9,436,106 B2 9/2016 Kuno et al.
9,436,107 B2 9/2016 Murakami et al.
9,459,545 B2 10/2016 Tanaka et al.
9,523,929 B2 12/2016 Nakamura et al.
9,535,346 B2 1/2017 Sekiya et al.
9,541,850 B2 1/2017 Nishida et al.
9,563,139 B2 2/2017 Kawahara et al.
9,575,422 B2 2/2017 Okuda et al.
9,599,915 B2 3/2017 Anezaki et al.
(Continued)

FOREIGN PATENT DOCUMENTS

JP 04260052 A * 9/1992
JP 2008-261933 10/2008

OTHER PUBLICATIONS

English language machine translation of JP-04260052-A (Year: 1992).*

(Continued)

*Primary Examiner* — Christopher D RoDee
(74) *Attorney, Agent, or Firm* — Venable LLP

(57) ABSTRACT

The present invention provides an electrophotographic photosensitive member sequentially including: a support; a photosensitive layer; and a protection layer formed on the support, wherein the protection layer has a triarylamine structure and a specific cyclic structure, and a specific A-value obtained by measurement using total reflection Fourier transform infrared spectroscopy is 0.010 or more and 0.050 or less.

9 Claims, 1 Drawing Sheet

(56) References Cited

U.S. PATENT DOCUMENTS

| | | | |
|---|---|---|---|
| 9,599,917 | B2 | 3/2017 | Okuda et al. |
| 9,645,515 | B2 | 5/2017 | Kuno et al. |
| 9,645,516 | B2 | 5/2017 | Kawahara et al. |
| 9,684,277 | B2 | 6/2017 | Yamamoto et al. |
| 9,726,992 | B2 | 8/2017 | Sakuma et al. |
| 9,772,596 | B2 | 9/2017 | Mitsui et al. |
| 9,791,792 | B2 | 10/2017 | Miyauchi et al. |
| 9,869,032 | B2 | 1/2018 | Kawahara et al. |
| 10,073,362 | B2 | 9/2018 | Fujii et al. |
| 2005/0208402 | A1 | 9/2005 | Tanaka et al. |
| 2006/0199092 | A1 | 9/2006 | Sugino et al. |
| 2014/0004450 | A1 | 1/2014 | Tokimitsu et al. |
| 2014/0093281 | A1 | 4/2014 | Takahashi et al. |
| 2014/0186758 | A1 | 7/2014 | Bellino et al. |
| 2015/0168908 | A1 | 6/2015 | Black |
| 2015/0185630 | A1 | 7/2015 | Ito et al. |
| 2015/0185631 | A1 | 7/2015 | Black et al. |
| 2015/0277246 | A1 | 10/2015 | Kaku et al. |
| 2015/0277247 | A1 | 10/2015 | Sekiya et al. |
| 2015/0316863 | A1 | 11/2015 | Tanaka et al. |
| 2015/0346616 | A1 | 12/2015 | Kawahara et al. |
| 2015/0346617 | A1 | 12/2015 | Kawahara et al. |
| 2015/0362847 | A1 | 12/2015 | Tanaka et al. |
| 2016/0091807 | A1 | 3/2016 | Tanaka et al. |
| 2016/0131985 | A1* | 5/2016 | Tanaka ..... G03G 5/0696 430/56 |
| 2017/0060008 | A1 | 3/2017 | Okuda et al. |
| 2017/0184986 | A1 | 6/2017 | Black et al. |
| 2017/0192368 | A1 | 7/2017 | Black |
| 2018/0059558 | A1 | 3/2018 | Ito et al. |
| 2018/0341190 | A1 | 11/2018 | Nishi et al. |
| 2019/0265602 | A1* | 8/2019 | Nakamura ..... G03G 5/0575 |
| 2019/0265603 | A1* | 8/2019 | Shimozawa ..... G03G 5/14721 |

OTHER PUBLICATIONS

Diamond, Arthur S. (ed.) Handbook of Imaging Materials. New York: Marcel-Dekker, Inc. pp. 145-164. (Year: 2002).*

* cited by examiner

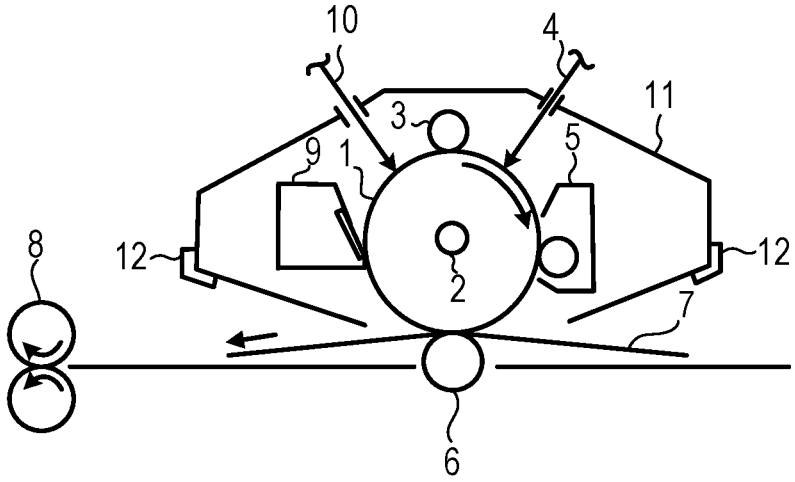
10
4
11
3
9
1
5
8
12
2
12
7
6

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present invention relates to an electrophotographic photosensitive member, and a process cartridge and an electrophotographic apparatus including the electrophotographic photosensitive member.

Description of the Related Art

An electrophotographic photosensitive member mounted in an electrophotographic apparatus has been extensively studied so far in order to improve image quality and durability. As one example thereof, there is a study to improve abrasion resistance (mechanical durability) by using a radically polymerizable resin to a surface of the electrophotographic photosensitive member. Meanwhile, a smeared image occurs in some cases as an adverse effect due to improvement in abrasion resistance. A smeared image is a phenomenon in which an output image is blurred due to blurring of an electrostatic latent image. It is considered that this is because a discharged product generated by charging remains on the surface of the electrophotographic photosensitive member, and a surface resistance of the surface of the electrophotographic photosensitive member changes under a high humidity environment.

U.S. Patent Application Publication No. 2014/186758 describes a technique of improving abrasion resistance with a protection layer obtained by polymerizing a monomer having a triarylamine structure and a monomer having a urethane group and an acryl group. In addition, Japanese Patent Application Laid-Open No. 2008-261933 describes a technique of reducing exposure memory by bringing the protection layer into contact with a critical fluid.

According to the study of the present inventors, it could be appreciated that the constitution disclosed in U.S. Patent Application Publication No. 2014/186758 has room for improvement in the exposure memory after storage under a high temperature and high humidity environment. Further, in the constitution disclosed in Japanese Patent Application Laid-Open No. 2008-261933, it could be appreciated that there is room for improvement in a smeared image.

SUMMARY OF THE INVENTION

Accordingly, an object of the present invention is to provide an electrophotographic photosensitive member having a protection layer that suppresses a smeared image and reduces exposure memory after storage under a high-temperature and high-humidity environment.

According to one aspect of the present invention, there is provided an electrophotographic photosensitive member sequentially including a support, a photosensitive layer, and a protection layer on the support, the protection layer has a triarylamine structure and a cyclic structure represented by General Formula (1) or (2) below:

(1)

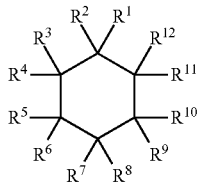

(in General Formula (1), among $R^1$ to $R^{12}$, at least two of $R^1$, $R^5$ and $R^9$ have a structure represented by General Formula (3) below, and the substituents except the substituents having the structure represented by General Formula (3) in $R^1$ to $R^{12}$ are a hydrogen atom or a methyl group), (2)

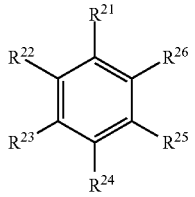

(in General Formula (2), among $R^{21}$ to $R^{26}$, at least two of $R^{21}$, $R^{23}$, and $R^{25}$ have a structure represented by General Formula (3) below, and the substituents except the substituents having the structure represented by General Formula (3) in $R^{21}$ to $R^{26}$ are a hydrogen atom or a methyl group), (3)

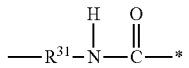

(in General Formula (3), $R^{31}$ is a single bond or a methylene group that may have a substituent, $R^{31}$ bonds to the ring in the cyclic structure represented by General Formula (1) or (2), and * indicates bonding site), and an A-value represented by Equation (4) below is 0.010 or more and 0.050 or less:

$$A = S1/S2 \quad (4)$$

(in Equation (4), S1 is a peak area based on in-plane deformation vibration of a terminal olefin (CH2=) and S2 is a peak area based on C═O stretching vibration among peak areas of spectrum obtained by measuring a surface of a protection layer by total reflection Fourier transform infrared spectroscopy using Ge as an internal reflection element and a measurement condition of an incident angle of 45°.

Further, according to another aspect of the present invention, there is provided a process cartridge detachably attachable to an electrophotographic apparatus main body, including the electrophotographic photosensitive member; and at least one unit selected from the group consisting of a charging unit, a developing unit, a transfer unit, and a cleaning unit; the electrophotographic photosensitive member and the at least one unit being integrally supported.

Further, according to another aspect of the present invention, there is provided an electrophotographic apparatus having the electrophotographic photosensitive member, a charging unit, an exposing unit, a developing unit, and a transfer unit.

Further features of the present invention will become apparent from the following description of exemplary embodiments with reference to the attached drawing.

BRIEF DESCRIPTION OF THE DRAWINGS

FIGURE is a schematic view illustrating an image forming apparatus and a process cartridge according to the present invention.

DESCRIPTION OF THE EMBODIMENTS

Hereinafter, the present invention will be described in detail with reference to preferred embodiments.

An electrophotographic photosensitive member (hereinafter also referred to as a photosensitive member) according to an embodiment of the present invention sequentially includes a support, a photosensitive layer, and a protection layer on the support, wherein the protection layer has a triarylamine structure and a cyclic structure represented by General Formula (1) or (2) below.

It is known that when abrasion resistance of the protection layer on a surface of the photosensitive member is improved, it is difficult to remove a discharged product, and thus a smeared image is easily generated. In order to solve this problem, it is effective to increase frictional force between the photosensitive layer and a contact member thereof and to improve an ability to remove the discharged product. In the present invention, the protection layer has a cyclic structure having a urethane group represented by General Formula (1) or (2) below, thereby improving elasticity and increasing the frictional force between the photosensitive member and the contact member. As a result, even in the case of a protection layer having excellent abrasion resistance, a smeared image can be suppressed within a favorable range.

(1)

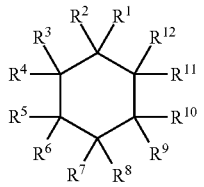

(in General Formula (1), among $R^1$ to $R^{12}$, at least two of $R^1$, $R^5$, and $R^9$ have a structure represented by General Formula (3) below, and the substituents except the substituents having the structure represented by General Formula (3) in $R^1$ to $R^{12}$ are a hydrogen atom or a methyl group), (2)

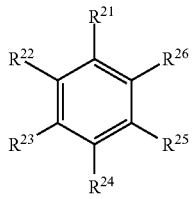

(in General Formula (2), among $R^{21}$ to $R^{26}$, at least two of $R^{21}$, $R^{23}$, and $R^{25}$ have a structure represented by General Formula (3) below, and the substituents except the substituents having the structure represented by General Formula (3) in $R^{21}$ to $R^{26}$ are a hydrogen atom or a methyl group), and (3)

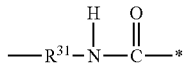

(in General Formula (3), $R^{31}$ is a single bond or a methylene group that may have a substituent $R^{31}$ bonds to the ring in the cyclic structure represented by General Formula (1) or (2), and * indicates bonding site).

Preferable examples of the structure represented by General Formula (1) are shown in (1-1) to (1-3). Among them, the structure represented by (1-1) is more preferable:

(1-1)

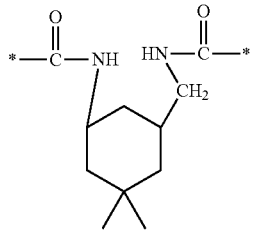

(1-2)

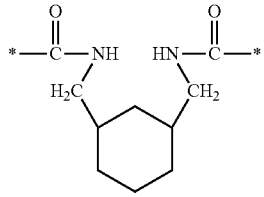

(1-3)

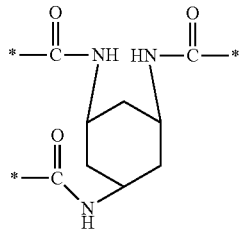

Preferable examples of the structure represented by General Formula (2) are shown in (2-1) to (2-5):

(2-1)

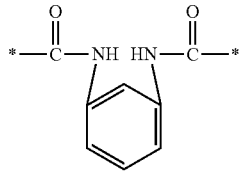

(2-2)

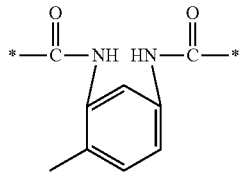

-continued (2-3)

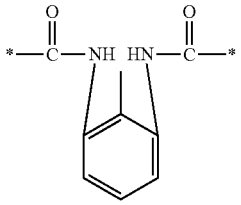

(2-4)

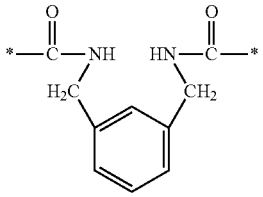

(2-5)

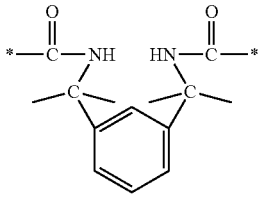

Meanwhile, it is known that the urethane group is gradually decomposed by hydrolysis. Accordingly, it could be appreciated that when the electrophotographic photosensitive member having the protection layer including the urethane group is stored for a long period of time in a high temperature and high humidity environment, the exposure memory is deteriorated in some cases. In order to solve this technical problem, as a result of studies to prevent infiltration of moisture into the protection layer, it could be appreciated that it is important to control the A-value to fall within a range of 0.010 or more and 0.050 or less. The A-value is a ratio expressed by Equation (4) below.

$$A=S1/S2 \quad (4)$$

In Equation (4), S1 is a peak area based on in-plane deformation vibration of a terminal olefin (CH2=) which is obtained by measuring a surface of a protection layer by total reflection Fourier transform infrared spectroscopy using Ge as an internal reflection element and a measurement condition of an incident angle of 45°. In addition, S2 is a peak area based on C═O stretching vibration. That is, it is considered that by controlling the terminal olefin having a 7C bond and exhibiting hydrophilicity to fall with the range defined above with respect to an ester group, penetration of moisture into the protection layer can be reduced to suppress hydrolysis of the urethane group.

From the viewpoint of improving frictional force of the contact member, an elastic deformation ratio of the protection layer is preferably 45% or more and 55% or less. The elastic deformation ratio is measured in an environment at a temperature of 23° C. and a humidity of 50% RH using a Fischer hardness tester (H100VP-HCU manufactured by Fischer Instrument Inc.). A Vickers square pyramid diamond indenter having a facing angle of 136° as an indenter is used, the indenter is pushed onto the surface of the protection layer which is an object to be measured and loaded to 2 mN over 7 seconds, and a push-in depth until the load is 0 mN by gradually reducing the load over 7 seconds is continuously measured. From the result, the elastic deformation ratio can be obtained.

It is preferable that a molar ratio of the cyclic structure represented by General Formula (1) or (2) to the triarylamine structure is 0.2 or more and 1.4 or less. In addition, it is preferable that the protection layer has a structure represented by General Formula (5) and a molar ratio of the structure represented by General Formula (5) to the cyclic structure is 1.9 or more and 2.1 or less. By having these constitutions of the protection layer, it is possible to maintain exposure memory and the frictional force after storage under high temperature and high humidity within a favorable range.

(5)

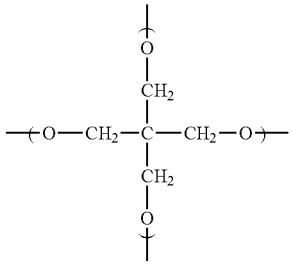

It is preferable that the protection layer has an unpolymerized triarylamine compound having a molecular weight of 300 or more and 1000 or less. Further, it is more preferable to have the triarylamine compound in a range of 1 mass % or more and 30 mass % or less with respect to the total mass of the protection layer. It is thought that by containing a low molecular triarylamine compound in the film of the protection layer to improve film density, infiltration of moisture into the protection layer can be reduced while maintaining good electrical characteristics.

Preferable examples of the triarylamine compound are shown in (6-1) to (6-3):

(6-1)

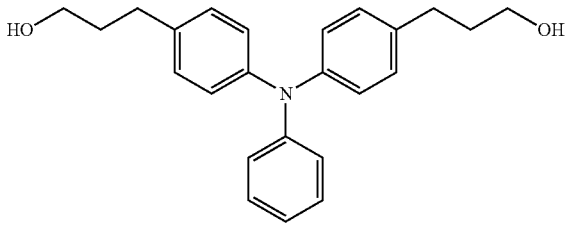

(6-2)

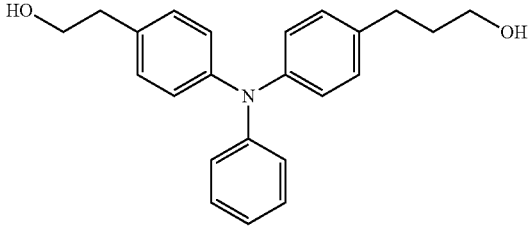

-continued (6-3)

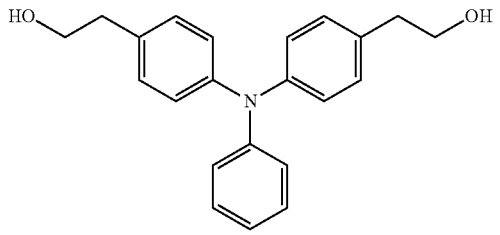

Further, the protection layer preferably has a siloxane structure or a fluoro group. It is considered that moisture infiltration into the protection layer can be reduced by having a siloxane structure or a fluoro group having a hydrophobic property in the protection layer.

As in the above mechanisms, it is possible to achieve effects of the present invention by having effects of the respective components in combination with each other.

[Electrophotographic Photosensitive Member]

An electrophotographic photosensitive member according to an embodiment of the present invention is characterized by including a support, a photosensitive layer, and a protection layer.

A method of producing an electrophotographic photosensitive member according to an embodiment of the present invention may include preparing coating liquids of respective layers described below, coating the coating liquids in a sequence of desired layers, followed by drying. Here, examples of a method of coating a coating liquid may include dip-coating, spray coating, ink jet coating, roll coating, die coating, blade coating, curtain coating, wire bar coating, ring coating, and the like. Among them, the dip-coating is preferable in view of efficiency and productivity.

Hereinafter, each layer is described.

<Support>

In the present invention, the electrophotographic photosensitive member has a support. In the present invention, the support is preferably a conductive support having conductivity. In addition, examples of a shape of the support may include a cylindrical shape, a belt shape, a sheet shape, and the like. Among them, a cylindrical support is preferable. In addition, electrochemical treatment such as anodic oxidation, or the like, blasting treatment, cutting treatment, or the like may be performed to the surface of the support.

As a material of the support, a metal, a resin, a glass, or the like, is preferable.

Examples of the metal may include aluminum, iron, nickel, copper, gold, stainless steel, or an alloy thereof, and the like. Among them, an aluminum support made of aluminum is preferable.

In addition, conductivity may be imparted to the resin or glass by a process such as mixing or coating with a conductive mater, or the like.

<Conductive Layer>

In the present invention, a conductive layer may be provided on the support. By providing the conductive layer, scratches or irregularities on the surface of the support can be concealed, and reflection of light on the surface of the support can be controlled.

The conductive layer preferably contains conductive particles and a resin.

Examples of a material of the conductive particle may include a metal oxide, a metal, carbon black, and the like.

Examples of the metal oxide may include zinc oxide, aluminum oxide, indium oxide, silicon oxide, zirconium oxide, tin oxide, titanium oxide, magnesium oxide, antimony oxide, bismuth oxide, and the like. Examples of the metal may include aluminum, nickel, iron, nichrome, copper, zinc, silver, and the like.

Among them, metal oxide is preferably used as the conductive particle, and more particularly, titanium oxide, tin oxide, and zinc oxide are preferably used.

When the metal oxide is used as the conductive particle, a surface of the metal oxide may be treated with a silane coupling agent, or the like, or the metal oxide may be doped with an element such as phosphorus, aluminum, or the like, or an oxide thereof.

In addition, the conductive particle may have a laminated structure including core material particles and a coating layer that covers the particles. Examples of the core material particles may include titanium oxide, barium sulfate, zinc oxide, and the like. Examples of the coating layer may include a metal oxide such as tin oxide and the like.

Further, when the metal oxide is used as the conductive particle, a volume average particle diameter thereof is preferably 1 nm or more and 500 nm or less, and more preferably 3 nm or more and 400 nm or less.

Examples of the resin may include a polyester resin, a polycarbonate resin, a polyvinyl acetal resin, an acrylic resin, a silicone resin, an epoxy resin, a melamine resin, a polyurethane resin, a phenol resin, an alkyd resin, and the like.

Further, the conductive layer may further contain a masking agent such as silicone oil, resin particles, titanium oxide, or the like.

An average film thickness of the conductive layer is preferably 1 μm or more and 50 μm or less, and particularly preferably 3 μm or more and 40 μm or less.

The conductive layer may be formed by preparing a coating liquid for a conductive layer containing each of the above-described materials and solvents, and forming a coating film, followed by drying. Examples of the solvent used for the coating liquid may include an alcohol-based solvent, a sulfoxide-based solvent, a ketone-based solvent, an ether-based solvent, an ester-based solvent, an aromatic hydrocarbon solvent, and the like. As a dispersing method for dispersing conductive particles in the coating liquid for a conductive layer, a method using a paint shaker, a sand mill, a ball mill, or a liquid collision type high-speed dispersing machine may be included.

<Undercoat Layer>

In the present invention, an undercoat layer may be provided on the support or the conductive layer. By providing the undercoat layer, an adhesion function between layers can be enhanced and charge injection preventing function can be imparted.

The undercoat layer preferably contains a resin. In addition, the undercoat layer may be formed as a cured film by polymerizing a composition containing a monomer having a polymerizable functional group.

Examples of the resin may include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamide acid resin, a polyimide resin, a polyamideimide resin, a cellulose resin, and the like.

Examples of the polymerizable functional group of the monomer having a polymerizable functional group may include an isocyanate group, a block isocyanate group, a methylol group, an alkylated methylol group, an epoxy group, a metal alkoxide group, a hydroxyl group, an amino group, a carboxyl group, a thiol group, a carboxylic acid anhydride group, a carbon-carbon double bond group, and the like.

In addition, the undercoat layer may further contain an electron transport material, a metal oxide, a metal, a conductive polymer, or the like, for the purpose of increasing electrical characteristics. Among them, the electron transport material and the metal oxide are preferably used.

Examples of the electron transport material may include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, a boron compound, and the like. The undercoat layer may be formed as a cured film by using an electron transport material having a polymerizable functional group as an electron transport material, and copolymerizing with an above-described monomer having a polymerizable functional group.

Examples of the metal oxide may include indium tin oxide, tin oxide, indium oxide, titanium oxide, zinc oxide, aluminum oxide, silicon dioxide, and the like. Examples of the metal may include gold, silver, aluminum, and the like.

Further, the undercoat layer may further contain an additive.

An average film thickness of the undercoat layer is preferably 0.1 μm or more and 50 μm or less, more preferably 0.2 μm or more and 40 μm or less, and particularly preferably 0.3 μm or more and 30 μm or less.

The undercoat layer may be formed by preparing a coating liquid for an undercoat layer containing each of the above-described materials and solvents, and forming a coating film, followed by drying and/or curing. Examples of the solvent used for the coating liquid may include an alcohol-based solvent, a ketone-based solvent, an ether-based solvent, an ester-based solvent, and an aromatic hydrocarbon-based solvent, and the like.

<Photosensitive Layer>

A photosensitive layer of the electrophotographic photosensitive member is mainly classified into (1) a laminate type photosensitive layer and (2) a monolayer type photosensitive layer. (1) The laminate type photosensitive layer includes: a charge generation layer containing a charge generating material; and a charge transport layer containing a charge transport material. (2) The monolayer type photosensitive layer includes a photosensitive layer containing both a charge generating material and a charge transport material.

(1) Laminate Type Photosensitive Layer

The laminate type photosensitive layer has a charge generation layer and a charge transport layer.

(1-1) Charge Generation Layer

The charge generation layer preferably contains a charge generating material and a resin.

Examples of the charge generating material may include an azo pigment, a perylene pigment, a polycyclic quinone pigment, an indigo pigment, and a phthalocyanine pigment, and the like. Among them, the azo pigment and the phthalocyanine pigment are preferable. Among the phthalocyanine pigments, an oxytitanium phthalocyanine pigment, a chlorogallium phthalocyanine pigment, and a hydroxygallium phthalocyanine pigment are preferable.

A content of the charge generating material in the charge generation layer is preferably 40 mass % or more and 85 mass % or less, more preferably 60 mass % or more and 80 mass % or less, with respect to the total mass of the charge generation layer.

Examples of the resin may include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, a polyvinyl chloride resin, and the like. Among them, the polyvinyl butyral resin is more preferable.

Further, the charge generation layer may further contain additives such as an antioxidant, an ultraviolet absorber, or the like. Specific examples of the additive may include a hindered phenol compound, a hindered amine compound, a sulfur compound, a phosphorus compound, and a benzophenone compound, and the like.

An average film thickness of the charge generation layer is preferably 0.1 μm or more and 1 μm or less, and more preferably 0.15 μm or more and 0.4 μm or less.

The charge generation layer may be formed by preparing a coating liquid for a charge generation layer containing each of the above-described materials and solvents, and forming a coating film, followed by drying. Examples of the solvent used for the coating liquid may include an alcohol-based solvent, a sulfoxide-based solvent, a ketone-based solvent, an ether-based solvent, an ester-based solvent, an aromatic hydrocarbon solvent, and the like.

(1-2) Charge Transport Layer

The charge transport layer preferably contains a charge transport material and a resin.

Examples of the charge transport material may include a polycyclic aromatic compound, a heterocyclic compound, a hydrazone compound, a styryl compound, an enamine compound, a benzidine compound, a triarylamine compound, and a resin having a group derived from these materials, and the like. Among them, the triarylamine compound and the benzidine compound are preferable.

A content of the charge transport material in the charge transport layer is preferably 25 mass % or more and 70 mass % or less, more preferably 30 mass % or more and 55 mass % or less, with respect to the total mass of the charge transport layer.

Examples of the resin may include a polyester resin, a polycarbonate resin, an acrylic resin, and a polystyrene resin, and the like. Among them, the polycarbonate resin and the polyester resin are preferable. As the polyester resin, a polyarylate resin is particularly preferable.

A content ratio (mass ratio) of the charge transport material and the resin is preferably from 4:10 to 20:10, and more preferably 5:10 to 12:10.

In addition, the charge transport layer may contain an additive such as an antioxidant, an ultraviolet absorber, a plasticizer, a leveling agent, a slipperiness-imparting agent, an abrasion resistance improving agent, or the like. Specific examples of the additive include a hindered phenol compound, a hindered amine compound, a sulfur compound, a phosphorus compound, a benzophenone compound, a siloxane modified resin, silicone oil, a fluorine resin particle, a polystyrene resin particle, a polyethylene resin particle, a silica particle, an alumina particle, a boron nitride particle, and the like.

An average film thickness of the charge transport layer is preferably 5 μm or more and 50 μm or less, more preferably 8 μm or more and 40 μm or less, and particularly preferably 10 μm or more and 30 μm or less.

The charge transport layer may be formed by preparing a coating liquid for a charge transport layer containing each of the above-described materials and solvents, and forming a coating film, followed by drying. Examples of the solvent used for the coating liquid may include an alcohol-based solvent, a ketone-based solvent, an ether-based solvent, an ester-based solvent, and an aromatic hydrocarbon-based solvent, and the like. Among these solvents, the ether-based solvent or the aromatic hydrocarbon-based solvent is preferable.

(2) Monolayer Type Photosensitive Layer

A monolayer type photosensitive layer may be formed by preparing a coating liquid for a photosensitive layer containing a charge generating material, a charge transport material, a resin and a solvent, and forming a coating film, followed by drying. The charge generating material, the charge transport material, and the resin are the same as the examples of the material in the above-described "(1) laminate type photosensitive layer".

<Protection Layer>

An electrophotographic photosensitive member according to an embodiment of the present invention has a protection layer on a photosensitive layer.

As described above, the protection layer has a triarylamine structure and a cyclic structure represented by General Formula (1) or (2) above. The protection layer may be formed as a cured film by polymerizing a composition containing a monomer having a polymerizable functional group. Examples of a reaction at this time may include a thermal polymerization reaction, a photopolymerization reaction, a radiation polymerization reaction, and the like. Examples of the polymerizable functional group included in the monomer having a polymerizable functional group may include an acrylic group, a methacrylic group, and the like. As the monomer having the polymerizable functional group, a material having charge transport ability may be used.

The protection layer may contain an additive such as an antioxidant, an ultraviolet absorber, a plasticizer, a leveling agent, a slipperiness-imparting agent, an abrasion resistance improving agent, or the like. Specific examples of the additive may include a hindered phenol compound, a hindered amine compound, a sulfur compound, a phosphorus compound, a benzophenone compound, a siloxane modified resin, silicone oil, a fluorine resin particle, a polystyrene resin particle, a polyethylene resin particle, a silica particle, an alumina particle, a boron nitride particle, and the like.

The protection layer may contain a conductive particle and/or a charge transport material and a resin.

Examples of the conductive particle may include particles of metal oxides such as titanium oxide, zinc oxide, tin oxide, indium oxide, and the like.

Examples of the charge transport material may include a polycyclic aromatic compound, a heterocyclic compound, a hydrazone compound, a styryl compound, an enamine compound, a benzidine compound, a triarylamine compound, and a resin having a group derived from these materials, and the like. Among them, the triarylamine compound and the benzidine compound are preferable.

Examples of the resin may include a polyester resin, an acrylic resin, a phenoxy resin, a polycarbonate resin, a polystyrene resin, a phenol resin, a melamine resin, an epoxy resin, and the like. Among them, the polycarbonate resin, the polyester resin, and the acrylic resin are preferable.

An average film thickness of the protection layer is preferably 0.5 μm or more and 10 μm or less, and particularly preferably 1 μm or more and 7 μm or less.

The protection layer may be formed by preparing a coating liquid for a protection layer containing each of the above-described materials and solvents, and forming a coating film, followed by drying and/or curing. Examples of the solvent used for the coating liquid may include an alcohol-based solvent, a ketone-based solvent, an ether-based solvent, a sulfoxide-based solvent, an ester-based solvent, and an aromatic hydrocarbon-based solvent.

[Process Cartridge and Electrophotographic Apparatus]

The process cartridge according to an embodiment of the present invention is characterized by including: the electrophotographic photosensitive member as described above; and at least one unit selected from the group consisting of a charging unit, a developing unit, a transfer unit, and a cleaning unit; the electrophotographic photosensitive member and the at least one unit being integrally supported, and being detachably attachable to an electrophotographic apparatus main body.

Further, the electrophotographic apparatus according to an embodiment of the present invention is characterized by including the electrophotographic photosensitive member as described above, a charging unit, an exposing unit, a developing unit, and a transfer unit.

FIGURE shows an example of a schematic constitution of an electrophotographic apparatus having a process cartridge provided with an electrophotographic photosensitive member.

Reference numeral 1 denotes a cylindrical electrophotographic photosensitive member which is rotationally driven on a shaft 2 at a predetermined peripheral speed in a direction of an arrow. A surface of the electrophotographic photosensitive member 1 is charged to a predetermined positive or negative electric potential by a charging unit 3. Further, in the drawings, a roller charging method by a roller type charging member is shown, but a charging method such as a corona charging method, a proximity charging method, an injection charging method, or the like may be adopted. A surface of the charged electrophotographic photosensitive member 1 is irradiated with exposure light 4 from an exposing unit (not shown), and an electrostatic latent image corresponding to desired image information is formed. The electrostatic latent image formed on the surface of the electrophotographic photosensitive member 1 is developed by a toner contained in a developing unit 5, and a toner image is formed on the surface of the electrophotographic photosensitive member 1. The toner image formed on the surface of the electrophotographic photosensitive member 1 is transferred to a transfer material 7 by a transfer unit 6. The transfer material 7 onto which the toner image is transferred is conveyed to a fixing unit 8, and is subjected to a toner image fixing process to be printed out of the electrophotographic apparatus. The electrophotographic apparatus may have a cleaning unit 9 for removing an adhesive material such as the toner remaining on the surface of the electrophotographic photosensitive member 1, or the like, after transfer. It is preferable that the cleaning unit is a cleaning blade having a urethane resin. Further, a so-called cleanerless system may be used in which the adhesive material is removed by the developing unit or the like without separately providing the cleaning unit. The electrophotographic apparatus may have a charge removing mechanism for removing electricity on the surface of the electrophotographic photosensitive member 1 with pre-exposure light 10 from a pre-exposing unit (not shown). Further, in order to detach and attach the process cartridge 11 according to an embodiment of the present invention to an electrophotographic apparatus main body, a guide unit 12 such as a rail or the like may be provided.

The electrophotographic photosensitive member according to an embodiment of the present invention may be used for a laser beam printer, an LED printer, a copying machine, a facsimile, a multifunction machine thereof, and the like.

EXAMPLE

Hereinafter, the present invention is described in more detail with reference to Examples and Comparative Examples. The present invention is not limited to the following Examples unless the present invention is out of the gist. Further, in the description of the following Examples, "part" is on a mass basis unless otherwise specified.

<Manufacture of Electrophotographic Photosensitive Member>

Example 1

An aluminum cylinder (JIS-A 3003, aluminum alloy) having a diameter of 24 mm and a length of 257.5 mm was used as a support (conductive support).

Next, the following materials were prepared.

214 parts of titanium oxide ($TiO_2$) particles (average primary particle diameter of 230 nm) coated with oxygen-deficient tin oxide ($SnO_2$) as metal oxide particles 132 parts of a phenolic resin (phenolic resin monomer/oligomer) (product name: Plyophen J-325, manufactured by Dainippon Ink and Chemicals, Inc., resin solid content: 60 mass %) as a binding material 98 parts of 1-methoxy-2-propanol as a solvent These materials were placed in a sand mill using 450 parts of glass beads having a diameter of 0.8 mm, subjected to a dispersion treatment under conditions of a rotation speed of 2000 rpm, a dispersion treatment time of 4.5 hours, and a setting temperature of cooling water of 18° C. to obtain a dispersion liquid. From this dispersion liquid, the glass beads were removed with a mesh (aperture: 150 μm). Silicone resin particles (Tospearl 120, manufactured by Momentive Performance Materials Inc., average particle diameter of 2 μm) as a surface roughness imparting material were added to the obtained dispersion liquid. The added amount of the silicone resin particles was set to be 10% by mass with respect to the total mass of the metal oxide particles and the binding material in the dispersion liquid after removing the glass beads. In addition, silicone oil (SH 28PA, manufactured by Dow Corning Toray Co., Ltd.) as a leveling agent was added to the dispersion liquid so that a content of the silicone was 0.01 mass % with respect to the total mass of the metal oxide particles and the binding material in the dispersion liquid. Next, a mixed solvent of methanol and 1-methoxy-2-propanol (mass ratio of 1:1) was added to the dispersion liquid so that the total mass (i.e., the mass of the solid content) of the metal oxide particles, the binding material, and the surface roughness imparting material in the dispersion was 67 mass % with respect to the mass of the dispersion liquid. Thereafter, by stirring, a coating liquid for a conductive layer was prepared. This coating liquid for a conductive layer was dip-coated on a support and heated at 140° C. for 1 hour to form a conductive layer having a film thickness of 30 μm.

Next, the following materials were prepared.

4 parts of an electron transport material (Formula E-1)

5.5 parts of block isocyanate (Duranate SBN-70D, manufactured by Asahi Kasei Chemicals Corporation)

0.3 parts of a polyvinyl butyral resin (S-LEC KS-5Z, manufactured by Sekisui Chemical Co., Ltd.)

0.05 parts of zinc hexanoate (II) as a catalyst (manufactured by Mitsuwa Chemicals Co., Ltd.)

These materials were dissolved in a mixed solvent of 50 parts of tetrahydrofuran and 50 parts of 1-methoxy-2-propanol to prepare a coating liquid for an undercoat layer. This coating liquid for the undercoat layer was dip-coated on the conductive layer and heated at 170° C. for 30 minutes to form an undercoat layer having a film thickness of 0.7 μM.

(E-1)

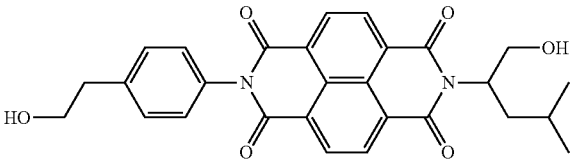

Next, in a chart obtained by CuKα characteristic X-ray diffraction, 10 parts of crystalline hydroxygallium phthalocyanine and 5 parts of a polyvinyl butyral resin (S-LEC BX-1, manufactured by Sekisui Chemical Co., Ltd.) having peaks at 7.5° and 28.4° were prepared. These materials were added to 200 parts of cyclohexanone and dispersed for 6 hours with a sand mill apparatus using glass beads having a diameter of 0.9 mm. To this dispersion liquid, 150 parts of cyclohexanone and 350 parts of ethyl acetate were further added and diluted to obtain a coating liquid for a charge generation layer. The obtained coating liquid was dip-coated on the undercoat layer and dried at 95° C. for 10 minutes to form a charge generation layer having a film thickness of 0.20 μm.

In addition, measurement of X-ray diffraction was performed under the following conditions.

[Powder X-Ray Diffraction Measurement]

Measuring machine used: X-ray diffractometer RINT-TTRII manufactured by Rigaku Denki Co., Ltd.
X-ray tube bulb: Cu
Tube voltage: 50 KV
Tube current: 300 mA
Scanning method: 2θ/θ scan
Scan speed: 4.0°/min
Sampling interval: 0.02°
Start angle (2θ): 5.0°
Stop angle (2θ): 40.0°
Attachment: Standard sample holder
Filter: Not used
Incident monochromator: Used
Counter monochromator: Not used
Divergence slit: Open
Divergence vertical restriction slit: 10.00 mm
Scattering slit: Open
Receiving slit: Open
Flat plate monochromator: Used
Counter: Scintillation counter Next, the following materials were prepared.

6 parts of a charge transport material (hole transport material) represented by Structural Formula (C-1)

3 parts of a charge transport material (hole transport material) represented by Structural Formula (C-2)

1 part of a charge transport material (hole transport material) represented by Structural Formula (C-3)

10 parts of polycarbonate (Iupilon Z400, manufactured by Mitsubishi Engineering-Plastics Corporation)

0.02 parts (x/y=0.95/0.05: viscosity average molecular weight=20000) of a polycarbonate resin having copolymerization units of Structural Formula (C-4) below and Structural Formula (C-5) below.

These materials were dissolved in a mixed solvent of 25 parts of ortho-xylene/25 parts of methyl benzoate/25 parts of dimethoxymethane to prepare a coating liquid for a charge transport layer. This coating liquid for a charge transport layer was dip-coated on the charge generation layer to form a coating film, and the coating film was dried at 120° C. for 30 minutes to form a charge transport layer having a film thickness of 12 μm.

(C-1)

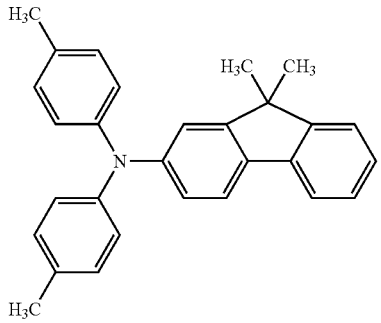

(C-2)

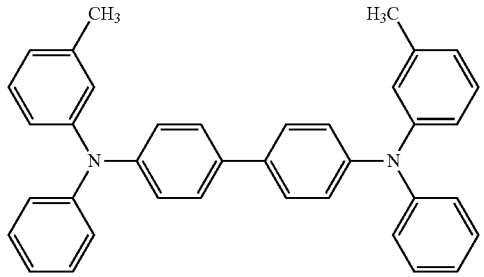

-continued (C-3)

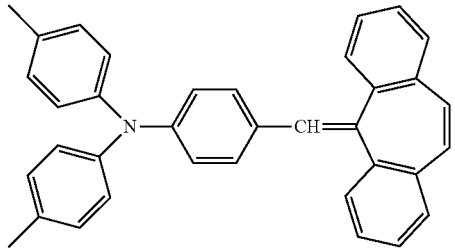

(C-4)

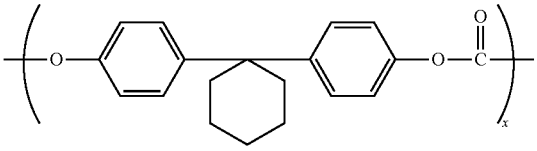

(C-5)

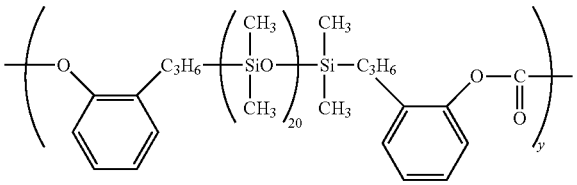

Next, the following materials were prepared.

9 parts of a compound represented by Structural Formula (OCL-1) below 9 parts of a compound represented by Structural Formula (L-1) below 2 parts of a compound represented by Structural Formula (6-1) below 0.2 parts by weight of a siloxane-modified acrylic compound (BYK-3550, manufactured by BYK Japan K.K.)

These materials were mixed with a mixed solvent of 72 parts of 2-propanol and 8 parts of tetrahydrofuran, and stirred. In this way, a coating liquid for a protection layer was prepared.

(OCL-1)

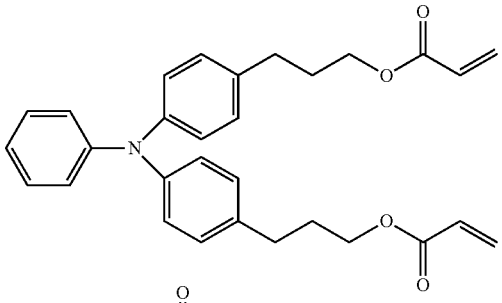

(L-1)

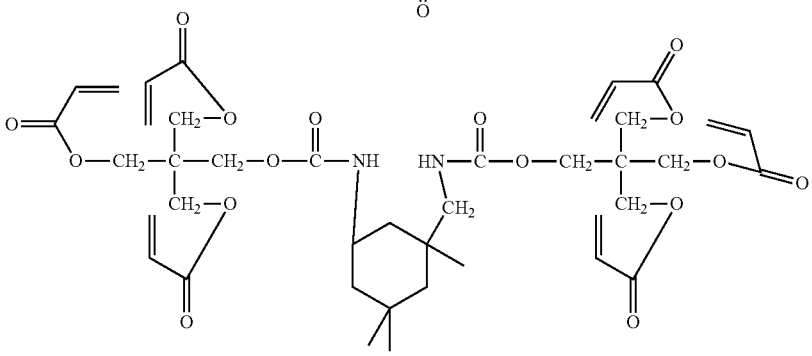

This coating liquid for a protection layer was dip-coated on the charge transport layer to form a coating film, and the obtained coating film was dried at 50° C. for 6 minutes. Thereafter, under a nitrogen atmosphere, the coating film was irradiated with an electron beam for 1.6 seconds while rotating the support (object to be irradiated) at a speed of 300 rpm under conditions of an acceleration voltage of 70 kV and a beam current of 5.0 mA. A radiation dose at the protection layer position was 15 kGy. Thereafter, a temperature of the coating film was raised to 117° C. under a nitrogen atmosphere. The oxygen concentration from the electron beam irradiation to the subsequent heat treatment was 10 ppm. Next, after natural cooling until the temperature of the coating film reached 25° C. in the atmosphere, heat treatment was performed for 1 hour under a condition that the temperature of the coating film became 120° C. to form a protection layer having a film thickness of 3 μm. In this way, a cylindrical (drum-shaped) electrophotographic photosensitive member having the protection layer of Example 1 was manufactured.

Example 2

An electrophotographic photosensitive member was manufactured in the same manner as in Example 1 except that the used amount of the compound represented by Structural Formula (OCL-1) was changed to 9.9 parts, the used amount of the compound represented by Structural Formula (L-1) was changed to 9.9 parts, and the used amount of the compound represented by Structural Formula (6-1) was changed to 0.2 parts.

Example 3

An electrophotographic photosensitive member was manufactured in the same manner as in Example 1 except that the used amount of the compound represented by Structural Formula (OCL-1) was changed to 7 parts, the used amount of the compound represented by Structural Formula (L-1) was changed to 7 parts, and the used amount of the compound represented by Structural Formula (6-1) was changed to 6 parts.

Example 4

An electrophotographic photosensitive member was manufactured in the same manner as in Example 1 except that 9 parts of the compound represented by Structural Formula (6-1) was changed to 9 parts of the compound represented by Structural Formula (6-2).

Example 5

An electrophotographic photosensitive member was manufactured in the same manner as in Example 1 except that 9 parts of the compound represented by Structural Formula (6-1) was changed to 9 parts of the compound represented by Structural Formula (6-3).

Example 6

An electrophotographic photosensitive member was manufactured in the same manner as in Example 1 except that the used amount of the compound represented by Structural Formula (OCL-1) was changed to 10 parts, the used amount of the compound represented by Structural Formula (L-1) was changed to 10 parts, and the compound represented by Structural Formula (6-1) was not used.

Example 7

An electrophotographic photosensitive member was manufactured in the same manner as in Example 6 except that 0.2 parts of the siloxane-modified acrylic compound (BYK-3550, manufactured by BYK Japan K.K.) was changed to 0.2 parts of a fluorine atom-containing resin (GF-400, manufactured by Toagosei Co., Ltd.).

Example 8

An electrophotographic photosensitive member was manufactured in the same manner as in Example 6 except that 0.2 parts of the siloxane-modified acrylic compound (BYK-3550, manufactured by BYK Japan K.K.) was not used.

Example 9

An electrophotographic photosensitive member was manufactured in the same manner as in Example 6 except that the used amount of the compound represented by Structural Formula (OCL-1) was changed to 16 parts and the used amount of the compound represented by Structural Formula (L-1) was changed to 4 parts.

Example 10

An electrophotographic photosensitive member was manufactured in the same manner as in Example 6 except that the used amount of the compound represented by Structural Formula (OCL-1) was changed to 4 parts and the used amount of the compound represented by Structural Formula (L-1) was changed to 16 parts.

Example 11

An electrophotographic photosensitive member was manufactured in the same manner as in Example 6 except that the used amount of the compound represented by Structural Formula (OCL-1) was changed to 14 parts and the used amount of the compound represented by Structural Formula (L-1) was changed to 6 parts.

Example 12

An electrophotographic photosensitive member was manufactured in the same manner as in Example 6 except that the used amount of the compound represented by Structural Formula (OCL-1) was changed to 6 parts and the used amount of the compound represented by Structural Formula (L-1) was changed to 14 parts.

Example 13

An electrophotographic photosensitive member was manufactured in the same manner as in Example 6 except that the used amount of the compound represented by Structural Formula (OCL-1) was changed to 10 parts and the used amount of the compound represented by Structural Formula (OCL-2) was changed to 10 parts.

(OCL-2)

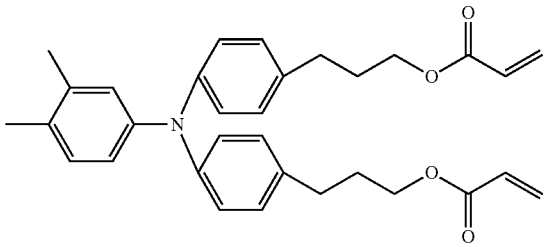

Example 14

An electrophotographic photosensitive member was manufactured in the same manner as in Example 6 except that the compound represented by Structural Formula (L-1) was changed to a compound represented by Structural Formula (L-2) below.

(L-2)

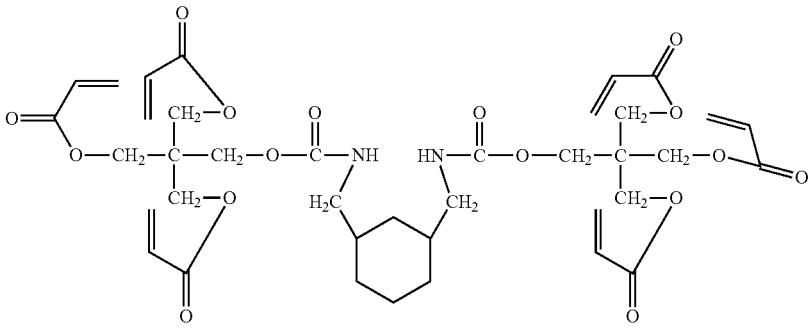

Example 15

An electrophotographic photosensitive member was manufactured in the same manner as in Example 6 except that the compound represented by Structural Formula (L-1) was changed to a compound represented by Structural Formula (L-3) below.

(L-3)

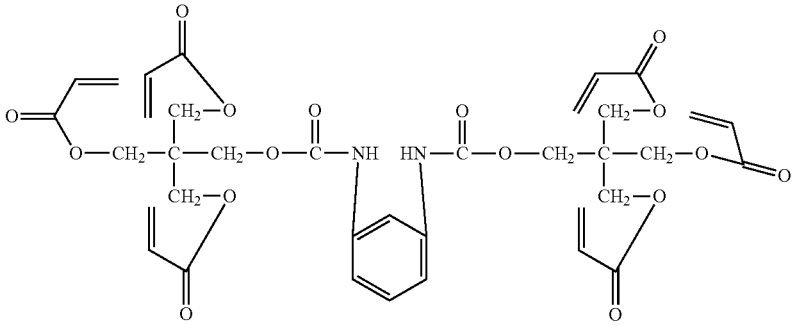

Example 16

An electrophotographic photosensitive member was manufactured in the same manner as in Example 6 except that the compound represented by Structural Formula (L-1) was changed to a compound represented by Structural Formula (L-4) below.

(L-4)

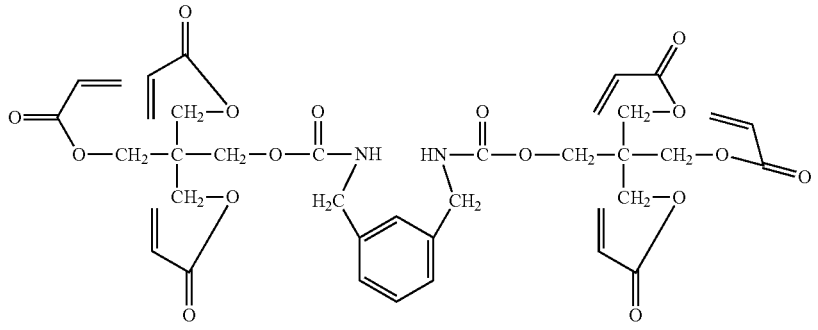

Example 17

An electrophotographic photosensitive member was manufactured in the same manner as in Example 6 except that the compound represented by Structural Formula (L-1) was changed to a compound represented by Structural Formula (L-5) below.

(L-5)

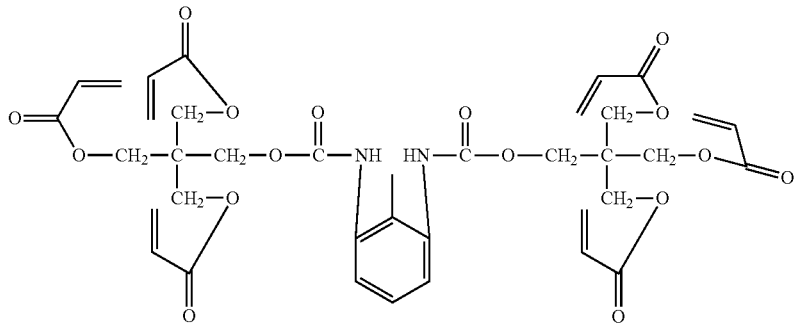

Example 18

An electrophotographic photosensitive member was manufactured in the same manner as in Example 6 except that the compound represented by Structural Formula (L-1) was changed to a compound represented by Structural Formula (L-6) below.

(L-6)

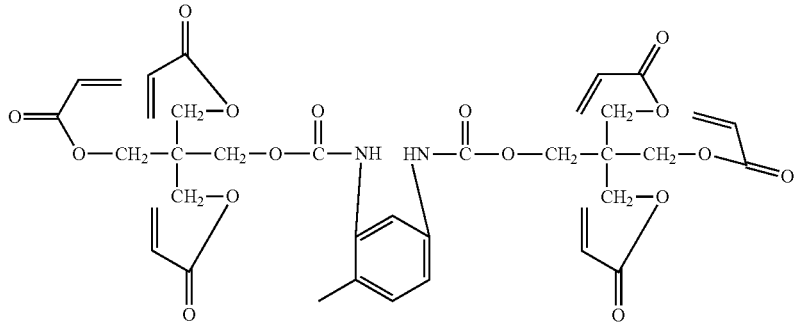

Example 19

An electrophotographic photosensitive member was manufactured in the same manner as in Example 6 except that the compound represented by Structural Formula (L-1) was changed to a compound represented by Structural Formula (L-7) below.

(L-7)

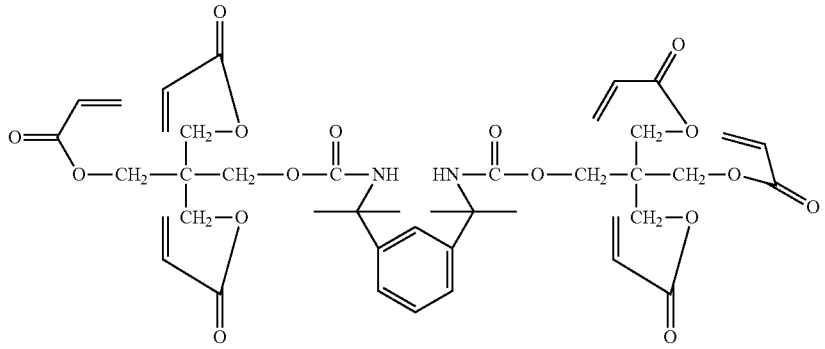

Example 20

An electrophotographic photosensitive member was manufactured in the same manner as in Example 6 except that the compound represented by Structural Formula (L-1) was changed to a compound represented by Structural Formula (L-8) below.

(L-8)

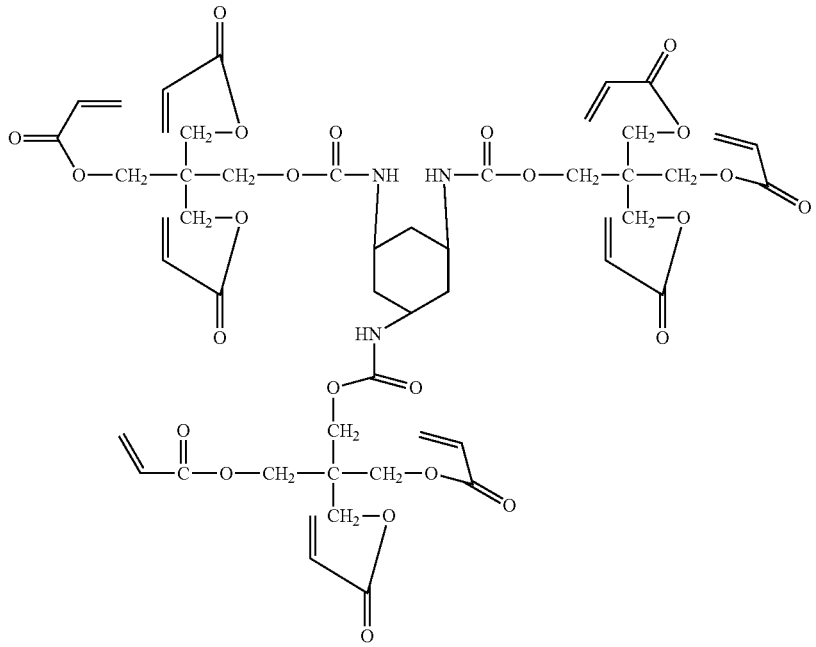

Example 21

An electrophotographic photosensitive member was manufactured in the same manner as in Example 6 except that at the time of electron beam irradiation, the acceleration voltage was changed to 120 kV, the beam current was changed to 16.0 mA, and the irradiation time was changed to 3.2 seconds. A radiation dose at the protection layer position was 200 kGy.

Example 22

An electrophotographic photosensitive member was manufactured in the same manner as in Example 6 except that at the time of electron beam irradiation, the acceleration voltage was changed to 120 kV, the beam current was changed to 12.0 mA, and the irradiation time was changed to 2.4 seconds. A radiation dose at the protection layer position was 100 kGy.

Example 23

An electrophotographic photosensitive member was manufactured in the same manner as in Example 6 except that at the time of electron beam irradiation, the oxygen concentration was changed to 970 ppm, and the irradiation time was changed to 2.0 seconds. A radiation dose at the protection layer position was 10 kGy.

Example 24

An electrophotographic photosensitive member was manufactured in the same manner as in Example 6 except that at the time of electron beam irradiation, the oxygen concentration was changed to 15 ppm, and the temperature of the coating film was not raised under a nitrogen atmosphere. A radiation dose at the protection layer position was 10 kGy.

Example 25

An electrophotographic photosensitive member was manufactured in the same manner as in Example 24 except that the beam current was changed to 2.0 mA and the irradiation time was changed to 0.4 seconds. A radiation dose at the protection layer position was 5 kGy.

Comparative Example 1

An electrophotographic photosensitive member of Comparative Example 1 was manufactured in the same manner as in Example 6 except that the compound represented by Structural Formula (L-1) was changed to a compound represented by Structural Formula (L-9) below.

(L-9)

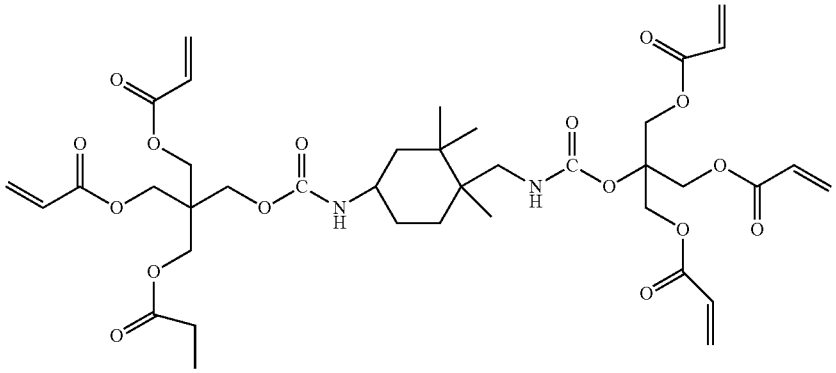

Comparative Example 2

An electrophotographic photosensitive member of Comparative Example 2 was manufactured in the same manner as in Example 6 except that the compound represented by Structural Formula (L-1) was changed to a compound represented by Structural Formula (L-10) below.

(L-10)

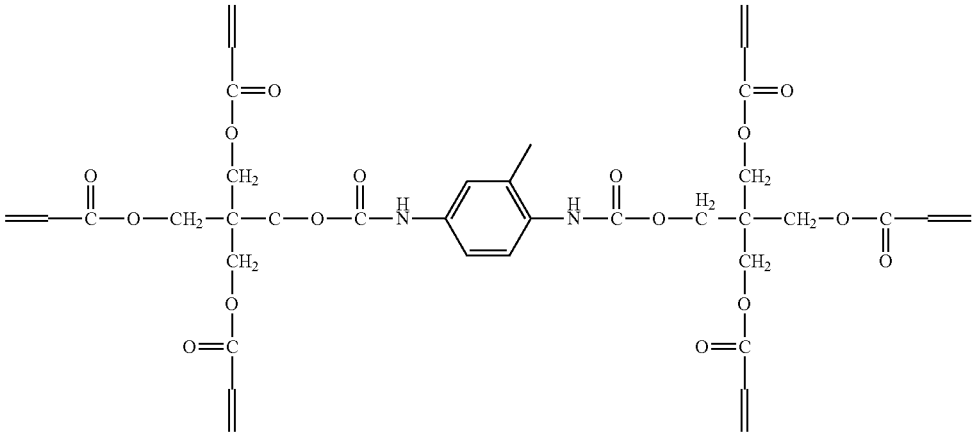

Comparative Example 3

An electrophotographic photosensitive member was manufactured in the same manner as in Example 6 except that at the time of electron beam irradiation, the oxygen concentration was changed to 500 ppm, the acceleration voltage was changed to 90 kV, the beam current was changed to 3.0 mA, and the irradiation time was changed to 1.2 seconds. A radiation dose at the protection layer position was 20 kGy.

Comparative Example 4

An electrophotographic photosensitive member was manufactured in the same manner as in Comparative Example 3 except that the beam current was changed to 6.0 mA. A radiation dose at the protection layer position was 40 kGy.

Comparative Example 5

An electrophotographic photosensitive member was manufactured in the same manner as in Comparative Example 3 except that the beam current was changed to 15.0 mA. A radiation dose at the protection layer position was 100 kGy.

Comparative Example 6

An electrophotographic photosensitive member was manufactured in the same manner as in Comparative Example 3 except that the irradiation time was changed to 2.4 seconds. A radiation dose at the protection layer position was 200 kGy.

<EB Irradiation Conditions>

EB irradiation conditions of the manufactured photosensitive members of Examples 1 to 25 and Comparative Examples 1 to 6 are shown in Table 1 below.

TABLE 1

| | EB irradiation condition | | | | | | |
|---|---|---|---|---|---|---|---|
| | Oxygen concentration (ppm) | Voltage value (kV) | Current value (mA) | Irradiation time (s) | Heating in hypoxic concentration (° C.) | Heating in atmosphere (° C.) | Radiation dose at protection layer position (kGy) |
| Example 1 | 10 | 70 | 5 | 1.6 | 117 | 120 | 15 |
| Example 2 | 10 | 70 | 5 | 1.6 | 117 | 120 | 15 |
| Example 3 | 10 | 70 | 5 | 1.6 | 117 | 120 | 15 |
| Example 4 | 10 | 70 | 5 | 1.6 | 117 | 120 | 15 |
| Example 5 | 10 | 70 | 5 | 1.6 | 117 | 120 | 15 |
| Example 6 | 10 | 70 | 5 | 1.6 | 117 | 120 | 15 |
| Example 7 | 10 | 70 | 5 | 1.6 | 117 | 120 | 15 |
| Example 8 | 10 | 70 | 5 | 1.6 | 117 | 120 | 15 |
| Example 9 | 10 | 70 | 5 | 1.6 | 117 | 120 | 15 |
| Example 10 | 10 | 70 | 5 | 1.6 | 117 | 120 | 15 |
| Example 11 | 10 | 70 | 5 | 1.6 | 117 | 120 | 15 |
| Example 12 | 10 | 70 | 5 | 1.6 | 117 | 120 | 15 |
| Example 13 | 10 | 70 | 5 | 1.6 | 117 | 120 | 15 |
| Example 14 | 10 | 70 | 5 | 1.6 | 117 | 120 | 15 |
| Example 15 | 10 | 70 | 5 | 1.6 | 117 | 120 | 15 |
| Example 16 | 10 | 70 | 5 | 1.6 | 117 | 120 | 15 |
| Example 17 | 10 | 70 | 5 | 1.6 | 117 | 120 | 15 |
| Example 18 | 10 | 70 | 5 | 1.6 | 117 | 120 | 15 |
| Example 19 | 10 | 70 | 5 | 1.6 | 117 | 120 | 15 |
| Example 20 | 10 | 70 | 5 | 1.6 | 117 | 120 | 15 |
| Example 21 | 10 | 120 | 16 | 3.2 | 117 | 120 | 200 |
| Example 22 | 10 | 120 | 12 | 2.4 | 117 | 120 | 100 |
| Example 23 | 970 | 70 | 5 | 2 | 117 | 120 | 10 |
| Example 24 | 15 | 70 | 5 | 1.6 | No heating | 120 | 10 |
| Example 25 | 15 | 70 | 2 | 0.4 | No heating | 120 | 5 |
| Comparative Example 1 | 10 | 70 | 5 | 1.6 | 117 | 120 | 15 |
| Comparative Example 2 | 10 | 70 | 5 | 1.6 | 117 | 120 | 15 |
| Comparative Example 3 | 500 | 90 | 3 | 1.2 | No heating | 120 | 20 |
| Comparative Example 4 | 500 | 90 | 6 | 1.2 | No heating | 120 | 40 |
| Comparative Example 5 | 500 | 90 | 15 | 1.2 | No heating | 120 | 100 |
| Comparative Example 6 | 500 | 90 | 15 | 2.4 | No heating | 120 | 200 |

<Analysis>

The manufactured photosensitive members of Examples 1 to 25 and Comparative Examples 1 to 6 were analyzed under the following conditions.

A surface of the obtained electrophotographic photosensitive member was scraped off with a razor to obtain a protection layer. First, this protection layer was immersed in chloroform and dried to extract the compound. This compound was analyzed with data obtained by 1H-NMR measurement (apparatus: AVANCE III 500 manufactured by BRUKER), thereby determining a content of the triarylamine compound. Next, the protection layer immersed in chloroform was dried and measured by pyrolysis gas chromatography. In this measurement, a molar ratio of the cyclic structure to the triarylamine structure and a molar ratio of the structure represented by General Formula (5) to the cyclic structure were determined by drawing the calibration curve.

(Measurement Conditions)

Apparatus: FT/IR-420 (manufactured by JASCO Corporation)

Attachment device: ATR device

IRE (internal reflection element): Ge

Incident angle: 45 degrees

Integration count: 320

Analysis results are listed in Table 2 below.

TABLE 2

Analysis results

| | Monomer having triarylamine structure | Monomer having cyclic structure | Molar ratio of cyclic structure to triarylamine structure | Molar ratio of structure represented by General Formula (5) to cyclic structure | Triarylamine compound | Mass ratio (%) of triarylamine compound to protection layer | Elastic deformation ratio (%) | A-value |
|---|---|---|---|---|---|---|---|---|
| Example 1 | OCL-1 | L-1 | 0.57 | 2.0 | (6-1) | 10% | 51 | 0.0180 |
| Example 2 | OCL-1 | L-1 | 0.57 | 2.0 | (6-1) | 1% | 51 | 0.0184 |
| Example 3 | OCL-1 | L-1 | 0.57 | 2.0 | (6-1) | 30% | 50 | 0.0155 |
| Example 4 | OCL-1 | L-1 | 0.57 | 2.0 | (6-2) | 10% | 52 | 0.0172 |
| Example 5 | OCL-1 | L-1 | 0.57 | 2.0 | (6-3) | 10% | 52 | 0.0176 |
| Example 6 | OCL-1 | L-1 | 0.57 | 2.0 | — | — | 52 | 0.0194 |
| Example 7 | OCL-1 | L-1 | 0.57 | 2.0 | — | — | 52 | 0.0191 |
| Example 8 | OCL-1 | L-1 | 0.57 | 2.0 | — | — | 52 | 0.0197 |
| Example 9 | OCL-1 | L-1 | 0.14 | 2.0 | — | — | 46 | 0.0158 |
| Example 10 | OCL-1 | L-1 | 2.29 | 2.0 | — | — | 52 | 0.0221 |
| Example 11 | OCL-1 | L-1 | 0.25 | 2.0 | — | — | 47 | 0.0171 |
| Example 12 | OCL-1 | L-1 | 1.34 | 2.0 | — | — | 52 | 0.0209 |
| Example 13 | OCL-2 | L-1 | 0.61 | 2.0 | — | — | 52 | 0.0189 |
| Example 14 | OCL-1 | L-2 | 0.60 | 2.0 | — | — | 52 | 0.0201 |
| Example 15 | OCL-1 | L-3 | 0.62 | 2.0 | — | — | 51 | 0.0210 |
| Example 16 | OCL-1 | L-4 | 0.60 | 2.0 | — | — | 52 | 0.0203 |
| Example 17 | OCL-1 | L-5 | 0.61 | 2.0 | — | — | 52 | 0.0199 |
| Example 18 | OCL-1 | L-6 | 0.61 | 2.0 | — | — | 52 | 0.0197 |
| Example 19 | OCL-1 | L-7 | 0.56 | 2.0 | — | — | 52 | 0.0192 |
| Example 20 | OCL-1 | L-8 | 0.43 | 3.0 | — | — | 49 | 0.0257 |
| Example 21 | OCL-1 | L-1 | 0.57 | 2.0 | — | — | 54 | 0.0102 |
| Example 22 | OCL-1 | L-1 | 0.57 | 2.0 | — | — | 53 | 0.0123 |
| Example 23 | OCL-1 | L-1 | 0.57 | 2.0 | — | — | 50 | 0.0373 |
| Example 24 | OCL-1 | L-1 | 0.57 | 2.0 | — | — | 50 | 0.0376 |
| Example 25 | OCL-1 | L-1 | 0.57 | 2.0 | — | — | 50 | 0.0495 |
| Comparative Example 1 | OCL-1 | L-9 | 0.57 | 2.0 | — | — | 44 | 0.0204 |
| Comparative Example 2 | OCL-1 | L-10 | 0.57 | 2.0 | — | — | 43 | 0.0210 |
| Comparative Example 3 | OCL-1 | L-1 | 0.57 | 2.0 | — | — | 47 | 0.0633 |
| Comparative Example 4 | OCL-1 | L-1 | 0.57 | 2.0 | — | — | 48 | 0.0584 |
| Comparative Example 5 | OCL-1 | L-1 | 0.57 | 2.0 | — | — | 48 | 0.0549 |
| Comparative Example 6 | OCL-1 | L-1 | 0.57 | 2.0 | — | — | 49 | 0.0512 |

Further, the elastic deformation ratio was measured in an environment at a temperature of 23° C. and a humidity of 50% RH using a Fischer hardness tester (H100VP-HCU manufactured by Fischer Corporation). A Vickers square pyramid diamond indenter having a facing angle of 136° was used as an indenter. The indenter was pushed onto a surface of the protection layer to be measure and loaded to 2 mN over 7 seconds, and a push-in depth until the load was 0 mN by gradually reducing the load over 7 seconds was continuously measured. From the result, the elastic deformation ratio was obtained.

Next, the infrared spectroscopic spectrum of the surface of the electrophotographic photosensitive member was measured under the following conditions using total reflection Fourier transform infrared spectroscopy to obtain an A-value. S1 had a peak area of 1413 $cm^{-1}$ to 1400 $cm^{-1}$ and S2 had a peak area of 1770 $cm^{-1}$ to 1700 $cm^{-1}$.

<Evaluation>

First, the manufactured photosensitive members of Examples 1 to 25 and the photosensitive members of Comparative Examples 1 to 6 were used to evaluate a smeared image under the following conditions.

As the electrophotographic apparatus, a modified machine of a HP LaserJet Enterprise Color M 553 do which is a laser beam printer manufactured by Hewlett-Packard Company was used. The electrophotographic apparatus used for the evaluation was modified so as to adjust and measure an image exposure amount, an amount of current flowing from a charging roller to the support of the electrophotographic photosensitive member (hereinafter, also referred to as total current), and a voltage applied to the charging roller.

First of all, the electrophotographic apparatus and the electrophotographic photosensitive member were allowed to stand in an environment of a temperature of 30° C. and a humidity of 80% RH for 24 hours or more, and then the electrophotographic photosensitive members of Examples and Comparative Examples were mounted on a cyan color cartridge of the electrophotographic apparatus.

Next, the applied voltage was gradually increased and applied from −400V to −2000V at intervals of 100V, and the total current at each applied voltage was measured. Then, a graph in which a horizontal axis represents the applied voltage and a vertical axis represents the total current was prepared, and an applied voltage at which a current value deviating from a primary approximate curve at the applied voltage of −400V to −800V became 100 μA was calculated and determined.

Next, a solid image was outputted with the single cyan color on A4 size plain paper, and an image exposure light amount was determined so that density on the paper was adjusted to 1.45 with a spectrodensitometer (X-Rite 504, manufactured by X-Rite Inc.).

Next, 10,000 square lattice images with A4 size, line width of 0.1 mm, and line spacing of 10 mm were continuously output with the single cyan color. After outputting the image, the main power source of the electrophotographic apparatus was turned off, and the electrophotographic apparatus was allowed to stand for 3 days under the environment of temperature 30° C./humidity 80% RH. After being allowed to stand and immediately after turning on the main power of the electrophotographic apparatus, one square lattice image was similarly output, and the smeared image of the output image was visually observed and evaluated according to the following criteria.

Evaluation rank was as follows.

Rank 5: No abnormality was observed in the lattice image.

Rank 4: The horizontal line of the lattice image was broken, but no abnormality was observed in the vertical line thereof.

Rank 3: The horizontal line of the lattice image disappeared, but no abnormality was observed in the vertical line thereof.

Rank 2: The horizontal line of the lattice image disappeared, and the vertical line thereof was broken.

Rank 1: The horizontal line of the lattice image disappeared, and the vertical line thereof also disappeared.

In this case, the horizontal line in the lattice image refers to a line parallel to a cylindrical axis direction of the photosensitive member, and the vertical line thereof refers to a line perpendicular to the cylindrical axis direction of the photosensitive member.

Next, the exposure memory after storage under a high temperature and high humidity environment was evaluated under the following conditions.

First of all, the electrophotographic photosensitive member were allowed to stand in an environment of a temperature of 40° C. and a humidity of 80% RH for 3 months or more, and then the electrophotographic photosensitive members of Examples and Comparative Examples were mounted on a cyan color cartridge of the electrophotographic apparatus.

Next, in an average electric potential in a circumferential direction of the electrophotographic photosensitive member at a position 120 mm from an upper end of the support of the electrophotographic photosensitive member, an applied voltage to the charging roller and an image exposure light amount were adjusted so that a dark portion electric potential was −500V and a bright portion electric potential was −100V. The surface electric potential of the cylindrical electrophotographic photosensitive member at the time of setting the electric potential was measured by modifying the cartridge, and mounting an electric potential probe (model 6000B-8, manufactured by Trek Japan Co., Ltd.) at a development position. The electric potential was measured using a surface electrometer (model344, manufactured by Trek Japan Co., Ltd.). The measurement was performed under a normal temperature and humidity environment at a temperature of 23° C. and a humidity of 50%.

The evaluation of the exposure memory was performed as follows. First, a part of the surface (peripheral surface) of the electrophotographic photosensitive member was shielded from light (light-shielding part), and a part that was not shielded (irradiated part) was irradiated with 1,500 lux of fluorescent light for 5 minutes. Next, the photosensitive member was mounted on the modified machine of the laser beam printer described above, charging and exposing were performed on each of the light-shielding part and the irradiated part, and a bright part electric potential of the surface was measured. A difference (electric potential difference) ΔV1 [V] between a bright part electric potential V1 of the irradiated part and a bright part electric potential V1 of the non-irradiated part was evaluated as photomemory.

$$\Delta V1 = V1 \text{ of irradiated part} - V1 \text{ of non-irradiated part}$$

As the ΔV1 is smaller, it means that photomemory is suppressed.

Evaluation results thereof are shown in Table 3.

TABLE 3

| | Evaluation results | |
|---|---|---|
| | Rank of smeared image | Photomemory (V) after storage under high temperature and high humidity environment |
| Example 1 | 5 | 4 |
| Example 2 | 5 | 4 |
| Example 3 | 5 | 3 |
| Example 4 | 5 | 4 |
| Example 5 | 5 | 4 |
| Example 6 | 5 | 6 |
| Example 7 | 5 | 7 |
| Example 8 | 5 | 9 |
| Example 9 | 3 | 6 |
| Example 10 | 5 | 11 |
| Example 11 | 4 | 6 |
| Example 12 | 5 | 8 |
| Example 13 | 5 | 6 |
| Example 14 | 5 | 7 |
| Example 15 | 5 | 8 |
| Example 16 | 5 | 8 |
| Example 17 | 5 | 7 |
| Example 18 | 5 | 7 |
| Example 19 | 5 | 7 |
| Example 20 | 4 | 9 |
| Example 21 | 5 | 6 |
| Example 22 | 5 | 6 |
| Example 23 | 5 | 12 |
| Example 24 | 5 | 12 |
| Example 25 | 5 | 17 |
| Comparative Example 1 | 1 | 10 |
| Comparative Example 2 | 1 | 10 |
| Comparative Example 3 | 4 | 26 |
| Comparative Example 4 | 4 | 25 |
| Comparative Example 5 | 4 | 22 |
| Comparative Example 6 | 4 | 21 |

Example 26

A conductive layer, an undercoat layer, a charge generation layer, and a charge transport layer were formed in the same manner as in Example 1. Next, the following materials were prepared.

10 parts of the compound represented by Structural Formula (OCL-1)

10 parts of the compound represented by Structural Formula (L-1)

0.2 parts by weight of a siloxane-modified acrylic compound (BYK-3550, manufactured by BYK Japan K.K.)

1 part of the compound (1-hydroxy-cyclohexyl-phenyl-ketone) represented by Structural Formula (7) below These materials were mixed with a mixed solvent of 72 parts of 2-propanol and 8 parts of tetrahydrofuran, and stirred. In this way, a coating liquid for a protection layer was prepared.

(7)

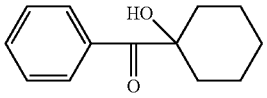

This coating liquid for a protection layer was dip coated on the charge transport layer to form a coating film, and the obtained coating film was dried at 50° C. for 6 minutes. Thereafter, under a nitrogen atmosphere, the coating film was UV-irradiated for 20 seconds using an electrodeless lamp H bulb (manufactured by Heraeus Co., Ltd.), while rotating the support (object to be irradiated) at a speed of 300 rpm under the condition of a lamp intensity of 0.7 W/cm$^2$. Then, a temperature of the coating film was raised to 117° C. under a nitrogen atmosphere. The oxygen concentration was always 10 ppm. Next, after natural cooling until the temperature of the coating film reached 25° C. in the atmosphere, heat treatment was performed for 1 hour under a condition that the temperature of the coating film became 120° C. to form a protection layer having a film thickness of 3 μm. In this way, a cylindrical (drum-shaped) electrophotographic photosensitive member having the protection layer of Example 26 was manufactured.

Example 27

An electrophotographic photosensitive member was manufactured in the same manner as in Example 26 except that at the time of UV irradiation, the oxygen concentration was changed to 30 ppm, the lamp intensity was changed to 0.6 W/cm$^2$, and the irradiation time was changed to 10 seconds.

Example 28

An electrophotographic photosensitive member was manufactured in the same manner as in Example 26 except that at the time of UV irradiation, the oxygen concentration was changed to 500 ppm, the lamp intensity was changed to 0.5 W/cm$^2$, and the irradiation time was changed to 2 seconds.

Comparative Example 7

An electrophotographic photosensitive member was manufactured in the same manner as in Example 27 except that UV irradiation was performed in the atmosphere, the temperature of the coating film was not raised under a nitrogen atmosphere, and the irradiation time was changed to 20 seconds.

<UV Producing Conditions>

The UV producing conditions of the manufactured photosensitive members of Examples 26 to 28 and the manufactured photosensitive member of Comparative Example 7 are shown in Table 4 below.

TABLE 4

| | UV producing conditions | | | | |
|---|---|---|---|---|---|
| | Oxygen concentration | Lamp intensity (W/cm$^2$) | Irradiation time (s) | Heating during nitrogen replacement (° C.) | Heating in atmosphere (° C.) |
| Example 26 | 10 ppm | 0.7 | 20 | 117 | 120 |
| Example 27 | 30 ppm | 0.6 | 10 | 117 | 120 |
| Example 28 | 500 ppm | 0.5 | 2 | 117 | 120 |
| Comparative Example 7 | 20.8% | 0.6 | 20 | No heating | 120 |

<Analysis>

The manufactured photosensitive members of Examples 26 to 28 and the photosensitive member of Comparative Example 7 were analyzed in the same manner as the photosensitive members of Examples 1 to 25 and the photosensitive members of Comparative Examples 1 to 6.

Analysis results are listed in Table 5 below.

TABLE 5

| | Analysis result | | | | | |
|---|---|---|---|---|---|---|
| | Monomer having triarylamine structure | Monomer having cyclic structure | Molar ratio of cyclic structure to triarylamine structure | Molar ratio of structure represented by General Formula (5) to cyclic structure | Elastic deformation ratio (%) | A-value |
| Example 26 | OCL-1 | L-1 | 0.57 | 2.0 | 53 | 0.0129 |
| Example 27 | OCL-1 | L-1 | 0.57 | 2.0 | 51 | 0.0231 |

TABLE 5-continued

| | Analysis result | | | | | |
|---|---|---|---|---|---|---|
| | Monomer having triarylamine structure | Monomer having cyclic structure | Molar ratio of cyclic structure to triarylamine structure | Molar ratio of structure represented by General Formula (5) to cyclic structure | Elastic deformation ratio (%) | A-value |
| Example 28 | OCL-1 | L-1 | 0.57 | 2.0 | 50 | 0.0356 |
| Comparative Example 7 | OCL-1 | L-1 | 0.57 | 2.0 | 49 | 0.0521 |

<Evaluation>

The smeared images and the exposure memory after storage under high temperature and high humidity environment of the photosensitive members of Examples 26 to 28 and the photosensitive member of Comparative Example 7 were evaluated in the same manner as the evaluation of the photosensitive members of Examples 1 to 25 and the photosensitive members of Comparative Examples 1 to 6.

Results thereof are shown in Table 6 below.

TABLE 6

| | Evaluation results | |
|---|---|---|
| | Smeared image | Photomemory (V) after storage under high temperature and high humidity environment |
| Example 26 | 5 | 6 |
| Example 27 | 5 | 10 |
| Example 28 | 5 | 12 |
| Comparative Example 7 | 4 | 22 |

According to an embodiment of the present invention, there is provided an electrophotographic photosensitive member having a protection layer that suppresses a smeared image and reduces exposure memory after storage under a high-temperature and high-humidity environment. Further, according to another embodiment of the present invention, it is possible to provide a process cartridge and an electrophotographic apparatus having excellent performance over a long period even under a high temperature and high humidity environment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-035736, filed Feb. 28, 2018, which is hereby incorporated by reference herein in its entirety.

What is claimed is:

1. An electrophotographic photosensitive member sequentially comprising:

a support, a photosensitive layer and a protection layer;

the protection layer being a cured film of a composition containing a first monomer and a second monomer;

the first monomer being selected from the group consisting of OCL-1 and OCL-2

(OCL-1)

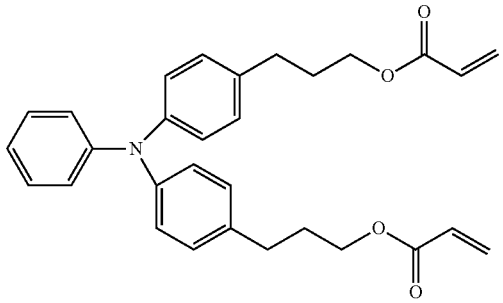

(OCL-2)

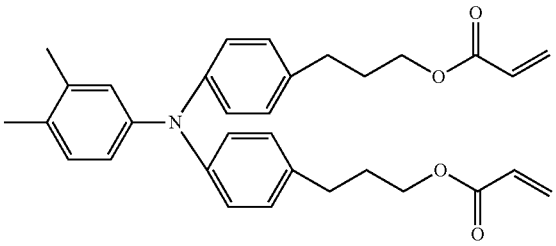

;

and the second monomer being selected from the group consisting of L-1, L-2, L-3, L-4, L-5, L-6, L-7 and L-8

(L-1)

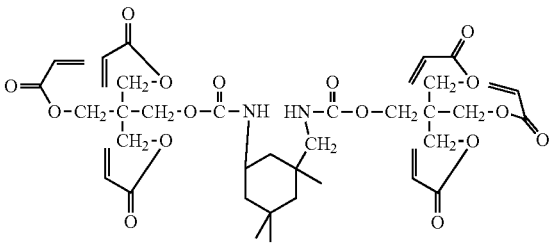

(L-2)

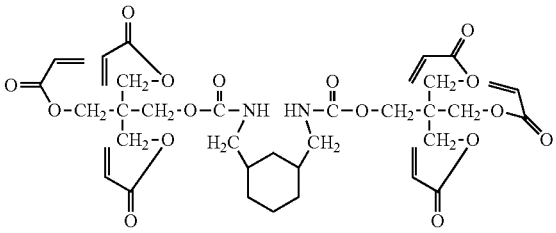

-continued (L-3)

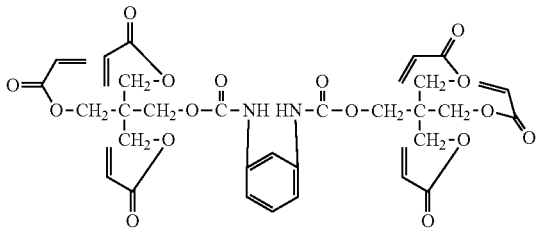

(L-4)

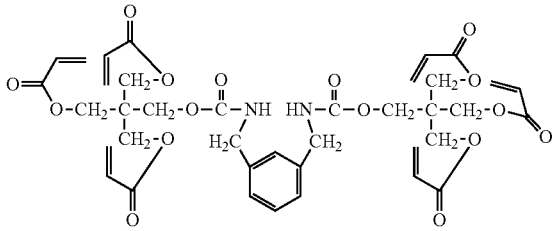

(L-5)

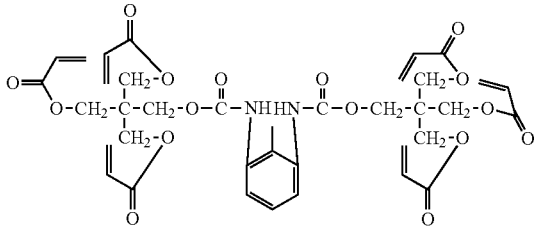

(L-6)

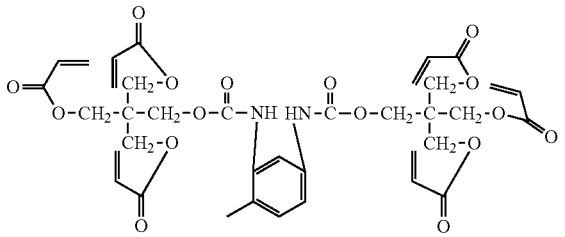

(L-7)

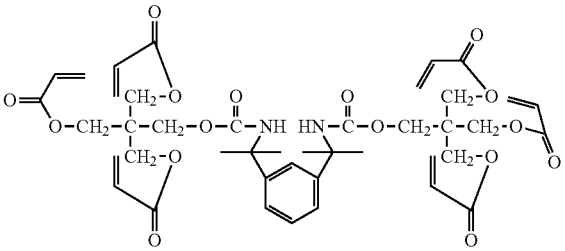

-continued (L-8)

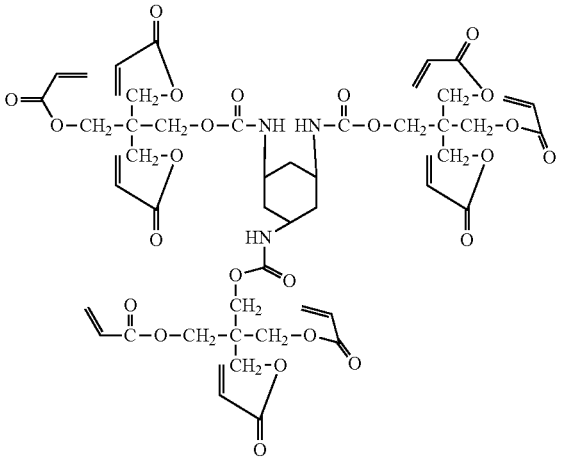

wherein A is 0.010 to 0.050 where A=S1/S2, S1 is a peak area based on in-plane deformation vibration of a terminal olefin derived from an acrylic group among peak areas of spectrum obtained by measuring a surface of said protection layer by total reflection Fourier transform infrared spectroscopy using Ge as an internal reflection element and a measurement condition of an incident angle of 45°, and S2 is a peak area based on C═O stretching vibration among peak areas of spectrum obtained by measuring said surface of said protection layer by total reflection Fourier transform infrared spectroscopy using Ge as an internal reflection element and a measurement condition of an incident angle of 45°.

2. The electrophotographic photosensitive member according to claim 1, wherein an elastic deformation ratio of the protection layer is 45 to 55%.

3. The electrophotographic photosensitive member according to claim 1, wherein a molar ratio of a cyclic structure contained in the second monomer to a triarylamine structure contained in the first monomer is 0.2 to 1.4.

4. The electrophotographic photosensitive member according to claim 1, wherein the protection layer further contains a triarylamine compound having a molecular weight of 300 to 1,000.

5. The electrophotographic photosensitive member according to claim 4, wherein the triarylamine compound is present in a range of 1 to 30 mass % with respect to the total mass of the protection layer.

6. The electrophotographic photosensitive member according to claim 1, wherein the protection layer further has a siloxane structure or a fluoro group.

7. A process cartridge detachably attachable to an electrophotographic apparatus main body, comprising:

an electrophotographic photosensitive member and at least one unit selected from the group consisting of a charging unit, a developing unit, a transfer unit and a cleaning unit;

the electrophotographic photosensitive member and the at least one unit being integrally supported;

the electrophotographic photosensitive member sequentially includes a support, a photosensitive layer and a protection layer;

the protection layer being a cured film of a composition containing a first monomer and a second monomer;

the first monomer being selected from the group consisting of OCL-1 and OCL-2
(OCL-1)
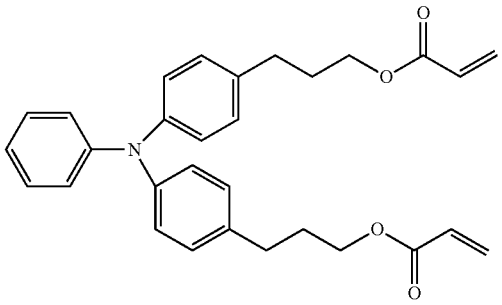
-continued
(OCL-2)
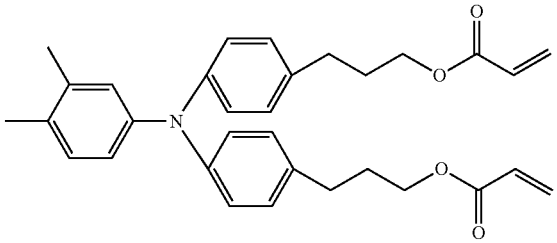
;
and
the second monomer being selected from the group consisting of L-1, L-2, L-3, L-4, L-5, L-6, L-7 and L-8
(L-1)
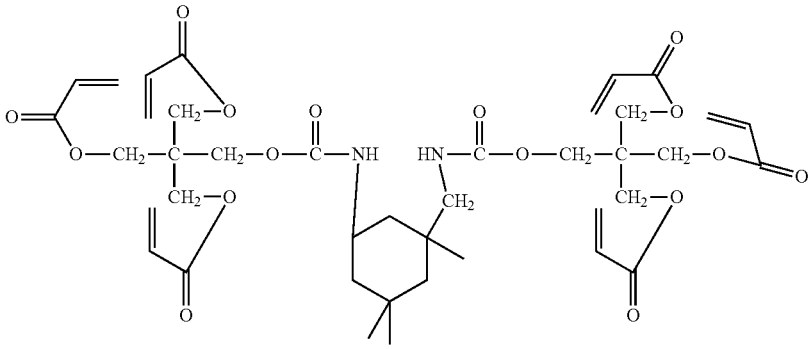
(L-2)
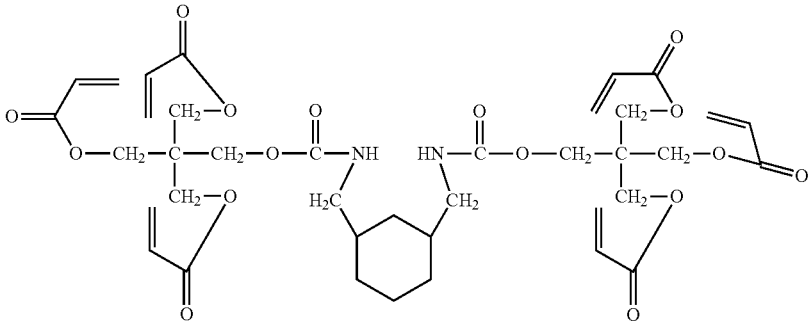
(L-3)
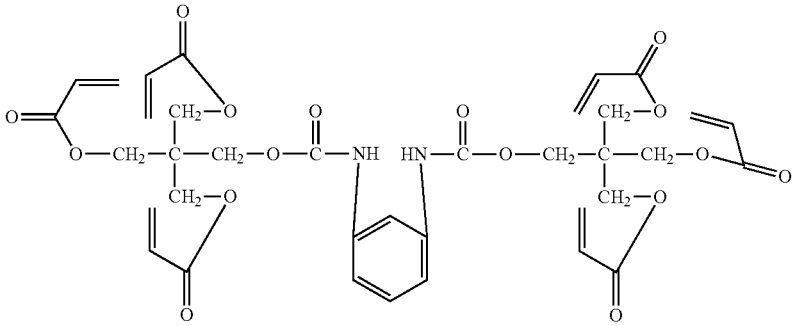

-continued
(L-4)
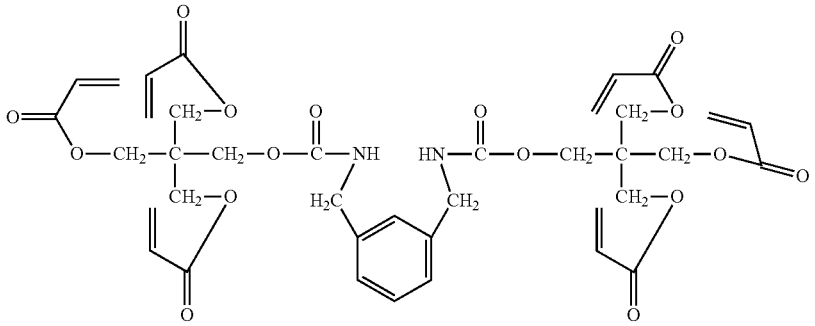
(L-5)
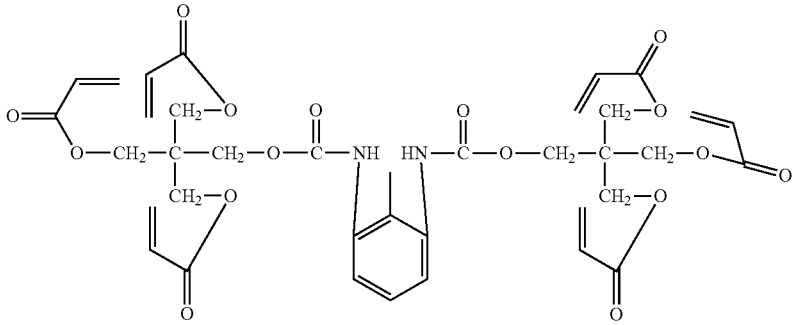
(L-6)
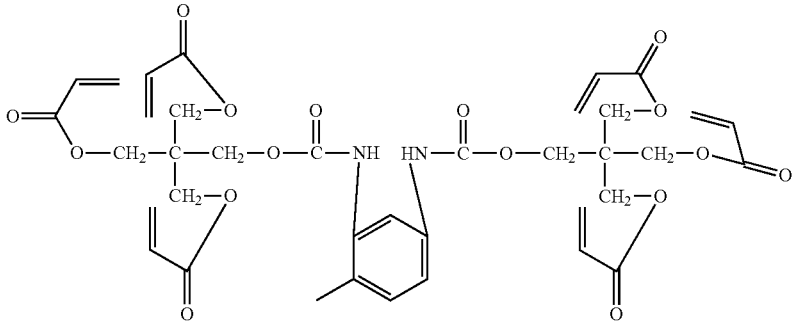
(L-7)
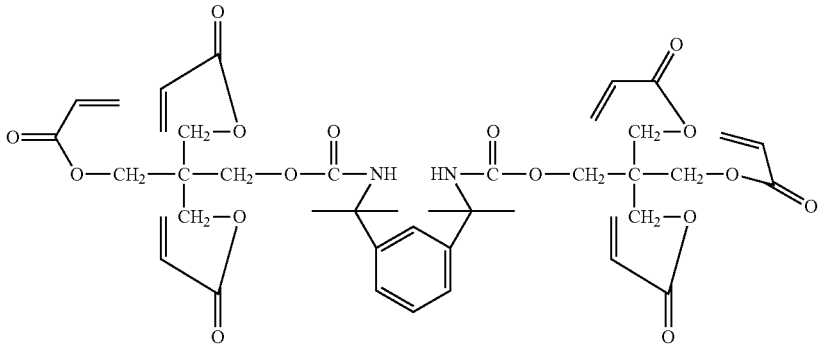

-continued (L-8)

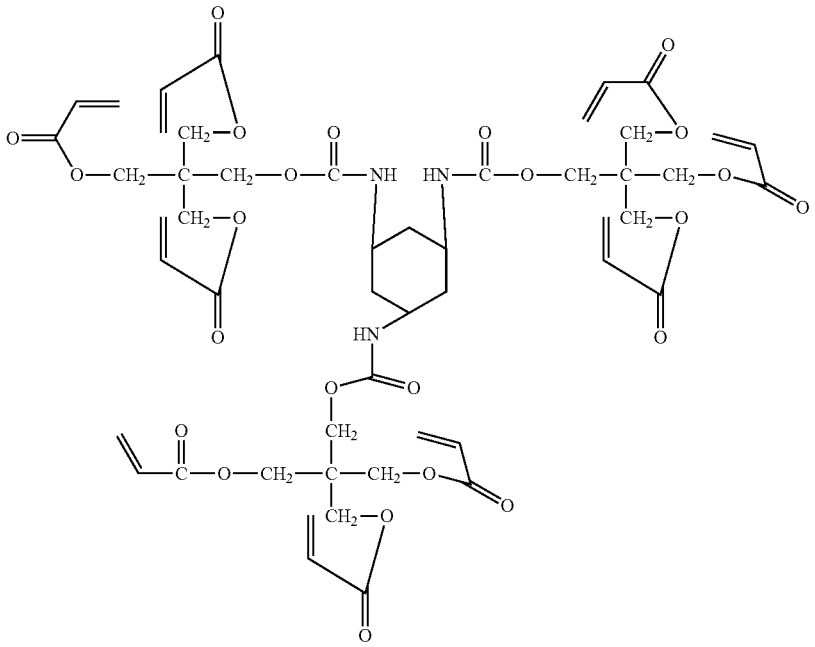

wherein A is 0.010 to 0.050 where A=S1/S2, S1 is a peak area based on in-plane deformation vibration of a terminal olefin derived from an acrylic group among peak areas of spectrum obtained by measuring a surface of said protection layer by total reflection Fourier transform infrared spectroscopy using Ge as an internal reflection element and a measurement condition of an incident angle of 45°, and S2 is a peak area based on C═O stretching vibration among peak areas of spectrum obtained by measuring said surface of said protection layer by total reflection Fourier transform infrared spectroscopy using Ge as an internal reflection element and a measurement condition of an incident angle of 45°.

8. The process cartridge according to claim 7, wherein the cleaning unit is a cleaning blade, and the cleaning blade is made of a urethane resin.

9. An electrophotographic apparatus comprising:

an electrophotographic photosensitive member, a charging unit, an exposing unit, a developing unit and a transfer unit;

the electrophotographic photosensitive member sequentially includes a support, a photosensitive layer, and a protection layer;

the protection layer being a cured film of a composition containing a first monomer and a second monomer, wherein the first monomer is selected from the group consisting of OCL-1 and OCL-2

(OCL-1)

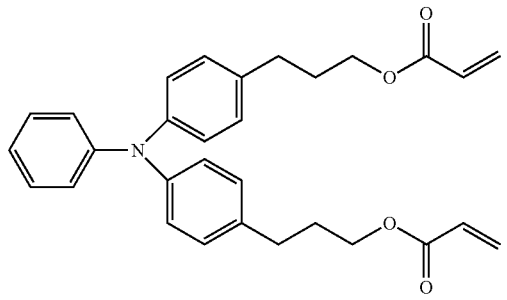

(OCL-2)

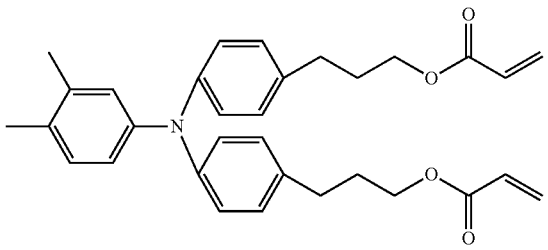

the second monomer is selected from the group consisting of L-1, L-2, L-3, L-4, L-5, L-6, L-7 and L-8

(L-1)
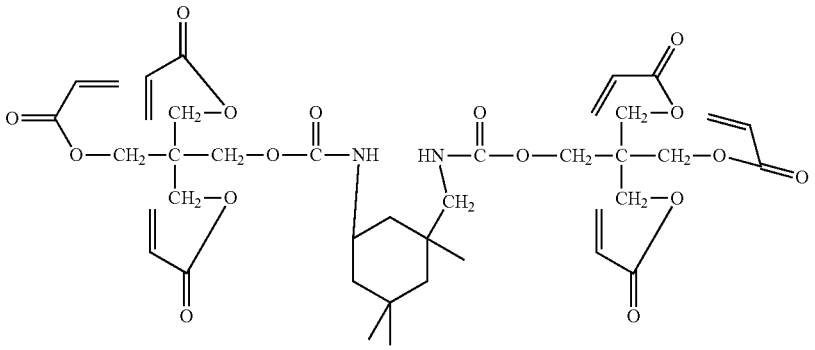
(L-2)
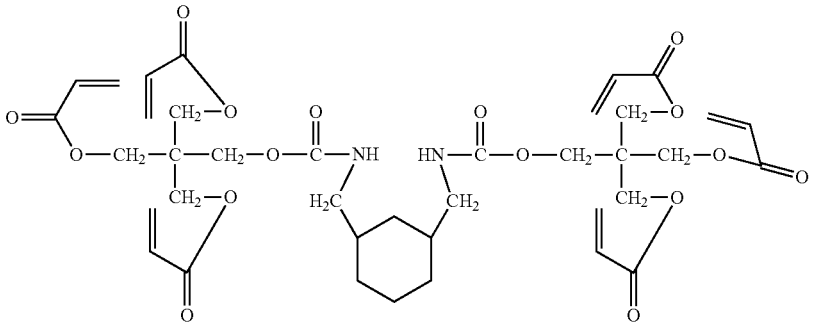
(L-3)
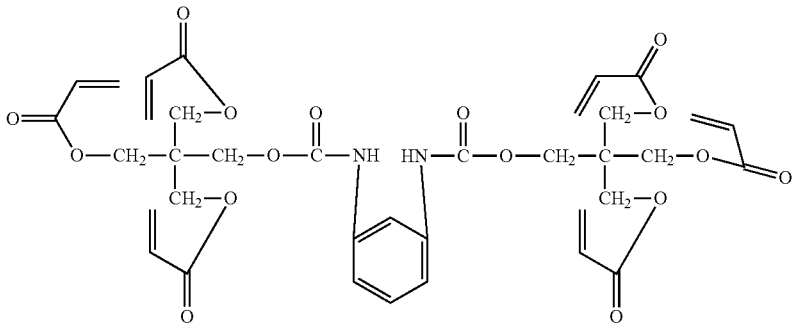
(L-4)
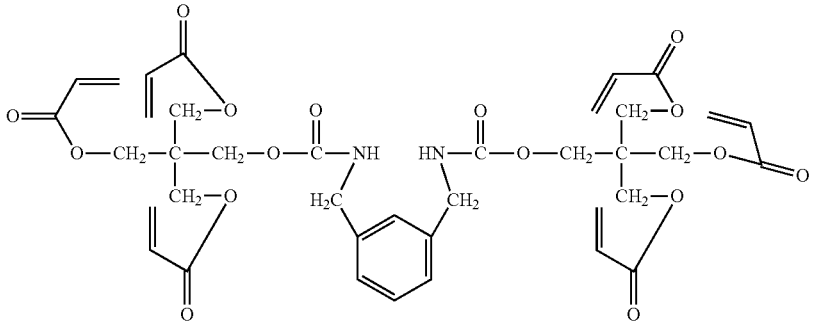

-continued
(L-5)
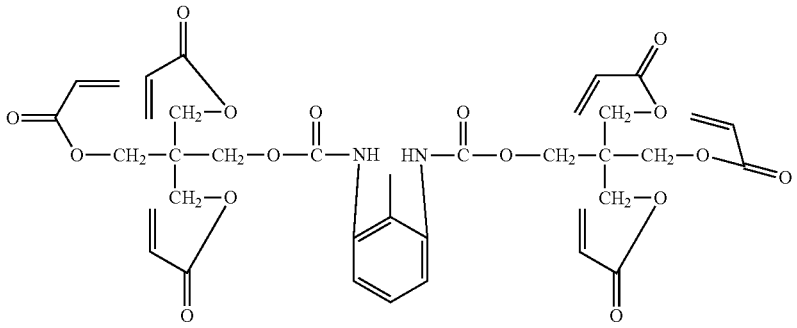
(L-6)
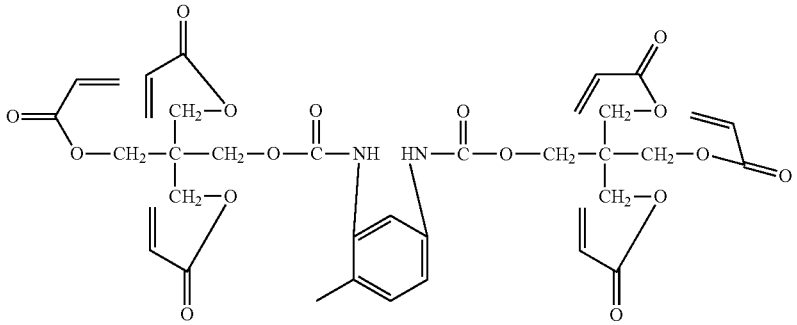
(L-7)
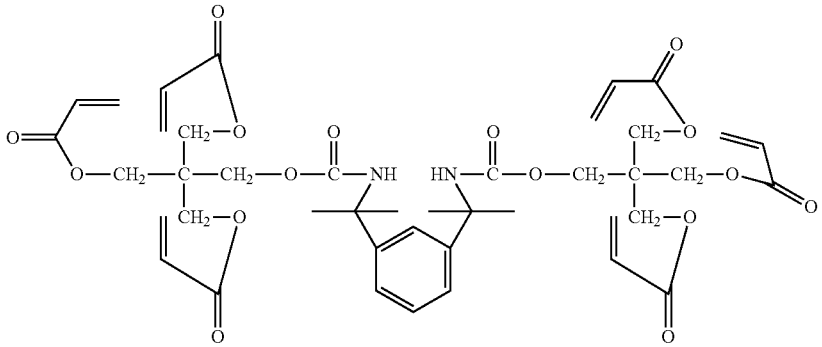
(L-8)
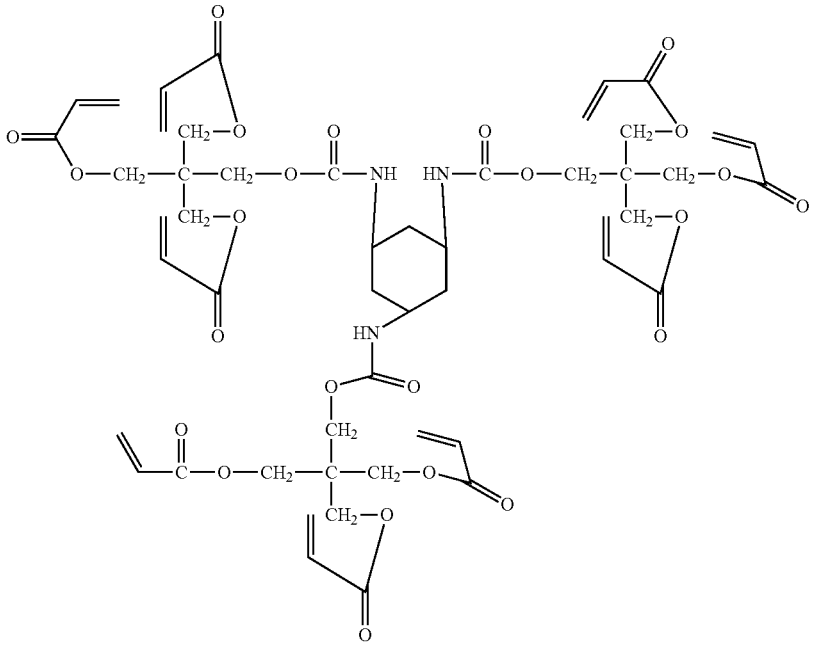

and A is 0.010 to 0.050 where A=S1/S2, S1 is a peak area based on in-plane deformation vibration of a terminal olefin derived from an acrylic group among peak areas of spectrum obtained by measuring a surface of said protection layer by total reflection Fourier transform infrared spectroscopy using Ge as an internal reflection element and a measurement condition of an incident angle of 45°, and S2 is a peak area based on C═O stretching vibration among peak areas of spectrum obtained by measuring said surface of said protection layer by total reflection Fourier transform infrared spectroscopy using Ge as an internal reflection element and a measurement condition of an incident angle of 45°.

* * * * *